US009357306B2

(12) United States Patent
Tammi et al.

(10) Patent No.: US 9,357,306 B2
(45) Date of Patent: May 31, 2016

(54) MULTICHANNEL AUDIO CALIBRATION METHOD AND APPARATUS

(71) Applicant: Nokia Technologies Oy, Espoo (FI)

(72) Inventors: Mikko Tapio Tammi, Tampere (FI); Anssi Sakari Rämö, Tampere (FI); Ravi Shenoy, Bangalore (IN); Sampo Vesa, Helsinki (FI)

(73) Assignee: Nokia Technologies Oy, Espoo (FI)

( * ) Notice: Subject to any disclaimer, the term of this patent is extended or adjusted under 35 U.S.C. 154(b) by 141 days.

(21) Appl. No.: 14/191,195

(22) Filed: Feb. 26, 2014

(65) Prior Publication Data

US 2014/0270282 A1 Sep. 18, 2014

(30) Foreign Application Priority Data

Mar. 12, 2013 (IN) ..... 1049/CHE/2013

(51) Int. Cl.
*H04R 5/02* (2006.01)
*H04S 7/00* (2006.01)
*H04R 1/02* (2006.01)

(52) U.S. Cl.
CPC *H04R 5/02* (2013.01); *H04S 7/301* (2013.01); *H04S 7/302* (2013.01); *H04S 7/308* (2013.01); *H04R 1/028* (2013.01); *H04R 2430/20* (2013.01); *H04R 2460/07* (2013.01)

(58) Field of Classification Search
CPC .... H04R 25/606; H04R 29/001; H04R 25/70; H04R 29/00; H04R 3/002; H04R 2430/03; H04R 2460/13
USPC ..... 381/300
See application file for complete search history.

(56) References Cited

U.S. PATENT DOCUMENTS

| | | | | |
|---|---|---|---|---|
| 6,798,889 | B1 | 9/2004 | Dicker et al. | |
| 8,270,620 | B2 * | 9/2012 | Christensen | H04S 7/301 381/300 |
| 2007/0269063 | A1 | 11/2007 | Goodwin et al. | |
| 2008/0232601 | A1 | 9/2008 | Pulkki | |
| 2012/0075957 | A1 | 3/2012 | De Bruijn | |
| 2013/0044884 | A1 * | 2/2013 | Tammi | H04R 5/02 381/26 |

FOREIGN PATENT DOCUMENTS

WO 2011/121004 A2 10/2011

OTHER PUBLICATIONS

"Multichannel Stereophonic Sound System with and without Accompanying Picture", Recommendation ITU-R BS.775-2, Jul. 2006, 13 pages.

(Continued)

*Primary Examiner* — Mark Blouin
(74) *Attorney, Agent, or Firm* — Alston & Bird LLP

(57) ABSTRACT

A method comprising: generating at least one audio signal to be output by at least one speaker for a multi-speaker system; receiving at least two output signals, the at least two output signals provided by at least two microphones and based on the at least one acoustic wave output by the at least one speaker in response to the at least one audio signal; determining a directional component associated with the at least two output signals; and comparing the directional component with an expected location of the at least one speaker.

20 Claims, 16 Drawing Sheets

(56) References Cited

OTHER PUBLICATIONS

"Genelec AutoCal", AutoCal—Fast, easy and consistent acoustic self-calibration, Retrieved on Feb. 18, 2014, Webpage available at : http://www.genelec.com/learning-center/key-technologies/dsp-monitoring-systems/autocal/.

"MCACC", Pioneer, Technology: MCACC—Amplifier, AV Receiver, Retrieved on Feb. 18, 2014, Webpage available at : http://www.pioneer.eu/eur/products/42/98/tech/AVAmplifierReceiver/AF_MCACC.html.

Craven, "Continuous Surround Panning for 5-Speaker Reproduction", AES 24th International Conference on Multichannel Audio, Jun. 1, 2003, 9 pages.

Porkka, "Modification of Multichannel Audio for Non-standard Loudspeaker Configurations", Acoustics and Audio Signal Processing, Apr. 6, 2009, 78 pages.

Schmitz, "SAFIR—Spatial Audio Framework for Instrumented Rooms", Workshop on Invisible and Transparent Interfaces, 2004, pp. 1-6.

Automatic Speaker Calibration Technologies (MCACC, YPAO, Audyssey MultEQ) | Eclectic Electronics [online] [retrieved Jan. 14, 2016]. Retrieved from the Internet Archive WaybackMachine <https://web.archive.org/web/20111117062232/http://www.eclecticelectronics.net/ht-home-theater/automatic-speaker-calibration-technologies-mcacc-ypao-audyssey-mubteq?>. (dated Nov. 17, 2011) 7 pages.

MultEQ from Audyssey—Balanced Sound—Automatically Customizes Home Theater System | Audyssey [online] [retrieved Jan. 14, 2016]. Retrieved from the Internet Archive WaybackMachine <URL: https://web.archive.org/web/20130808190331/http://wwww.audyssey.com/audio-technology/multeq> (dated Aug. 8, 2013) 3 pages.

AutoCal—Fast, easy and consistent acoustic self-calibration [online] [retrieved Jan. 14, 2016]. Retrieved from the Internet Archive WaybackMachine: <URL: https://web.archieve.org/web/20130620150025/http://www.genelec.com/learning-center/key-technologies/dsp-monitoring-systems/autocal/>. (dated Jun. 20, 2013) 2 pages.

Audio & Visual—Yamaha—Asia / Middle East / Oceania / Latin America [online] [retrieved Jan. 15, 2016]. Retrieved from the Internet Archive WaybackMachine: http://web.archive.org/web/20140116042337/http://asia.yamaha.com/en/products/audio-visual/>. (Jan. 16, 2014) 2 pages.

MCACC Multi-Channel Acoustic Calibration System (Pioneer) http://www.pioneer.eu/chd/products/42/98tech/AVAmplifier-Receiver/AF_MCACC.html.

* cited by examiner

MULTICHANNEL AUDIO CALIBRATION METHOD AND APPARATUS

FIELD

The present application relates to apparatus for audio capture and processing of audio signals for calibration and playback. The invention further relates to, but is not limited to, apparatus for audio capture and processing audio signals for calibration and playback within home theatre equipment.

BACKGROUND

Spatial audio signals are being used in greater frequency to produce a more immersive audio experience. A stereo or multi-channel recording can be passed from the recording or capture apparatus to a listening apparatus and replayed using a suitable multi-channel output such as a pair of headphones, headset, multi-channel loudspeaker arrangement etc.

Home theatre or home cinema multi-channel playback systems may have for example 6 or 8 speakers arranged in a 5.1 or 7.1 setup or configuration respectively. In the standard setup the speakers are equidistant from the listening position and the angles of the speakers are defined. The positions of speakers in a typical 5.0 system are illustrated in FIG. 11, where a centre speaker (C, or FC) 1003 is located directly in front of the listener, the front left speaker (FL) 1005 located 30° to the left of centre, the front right speaker (FR) 1007 located 30° to the right of centre, the rear left (RL) or left surround speaker 1009 located 110° to the left of centre and the rear right (RR) or right surround speaker 1011 located 110° to the right of centre.

However the location of the speakers in practical configurations and setups are typically defined by the room size and shape, furniture location, location of the display (TV/whiteboard). Thus, the distances and angles of the speakers with respect to a 'seated' location may vary from configuration to configuration, and in many cases are not located symmetrically around listener. Playback of audio using typical configurations can fail to replicate the experience that the recording material intends.

SUMMARY

Aspects of this application thus provide an audio calibration or playback process whereby typical sub-optimal speaker location or positioning can be compensated for.

According to a first aspect there is provided an apparatus comprising at least one processor and at least one memory including computer code for one or more programs, the at least one memory and the computer code configured to with the at least one processor cause the apparatus to: generate at least one audio signal to be output by at least one speaker for a multi-speaker system; receive at least two output signals, the at least two output signals provided by at least two microphones and based on the at least one acoustic wave output by the at least one speaker in response to the at least one audio signal; determine a directional component associated with the at least two output signals; and compare the directional component with an expected location of the at least one speaker.

The apparatus may be further caused to: determine a speaker positioning difference when the directional component associated with the at least two speaker signals differs with the expected location; and generate a speaker positioning error message to be displayed.

Generating a speaker positioning error to be displayed may cause the apparatus to generate a message comprising at least one of: speaker identification associated with the at least one speaker; an error value associated with the speaker positioning error; and correction information to correct the speaker positioning error.

The apparatus may be further caused to: generate a speaker correction factor based on the difference between the directional component and the expected location of the at least one speaker.

The apparatus may be further caused to apply the speaker correction factor during operation of the multi-speaker system such to correct the audio positioning of the at least one speaker, wherein applying the speaker correction factor may cause the apparatus to parameterise an audio signal to be output into an audio signal comprising location components; and synthesise an audio signal to be output by the at least one speaker in the multi-speakers based on the location components of the audio signal to be output and the speaker correction factor associated with the at least one speaker.

The apparatus may be further caused to transmit the speaker correction factor to the multi-speaker system for correcting the location of the at least one speaker towards the expected location of the at least one speaker.

The apparatus may be further caused to: compare a power/volume level associated with the at least two output signals and an expected power/volume level of the at least one audio signal to be output by the at least one speaker for the multi-speaker system; and determine whether the at least one speaker is at least one of: missing; not connected; incorrectly connected, based on the comparison.

Determining a directional component associated with the at least two output signals may cause the apparatus to generate more than one directional component; and comparing the directional component with an expected location of the at least one speaker may cause the apparatus to compare each directional component with an expected location of at least two speakers to determine whether the relative location of at least two of the speakers is correct.

According to a second aspect there is provided apparatus comprising at least one processor and at least one memory including computer code for one or more programs, the at least one memory and the computer code configured to with the at least one processor cause the apparatus to at least: receive a speaker correction factor for correcting the location of the at least one speaker of a multi-speaker system towards an expected location of at least one speaker; and generate an audio signal to be output by the multi-speakers based on the speaker correction factor.

Generating an audio signal to be output by the multi-speakers based on the speaker correction factor may cause the apparatus to: parameterise an audio signal to be output into an audio signal comprising location components; and synthesise an audio signal to be output by at least one speaker in the multi-speakers based on the location components of the audio signal to be output and the speaker correction factor associated with the at least one speaker.

The apparatus may be further caused to determine an expected location of the at least one speaker.

Determining an expected location of the at least one speaker further may cause the apparatus to: determine a speaker configuration; and determine an expected location of the at least one speaker from the speaker configuration.

Determining an expected location of the at least one speaker from the speaker configuration may further cause the apparatus to perform at least one of: select an expected location of a speaker from the speaker configuration which has the smallest difference when comparing the directional component with the expected location of the speaker; select an expected location from the speaker configuration according a defined order of selection in the speaker configuration; and select an expected location of a speaker from the speaker configuration based on a user interface input.

According to a third aspect there is provided an apparatus comprising: means for generating at least one audio signal to be output by at least one speaker for a multi-speaker system; means for receiving at least two output signals, the at least two output signals provided by at least two microphones and based on the at least one acoustic wave output by the at least one speaker in response to the at least one audio signal; means for determining a directional component associated with the at least two output signals; and means for comparing the directional component with an expected location of the at least one speaker.

The apparatus may further comprise: means for determining a speaker positioning difference when the directional component associated with the at least two speaker signals differs with the expected location; and means for generating a speaker positioning error message to be displayed.

The means for generating a speaker positioning error message to be displayed may comprise means for generating a message comprising at least one of: speaker identification associated with the at least one speaker; an error value associated with the speaker positioning error; and correction information to correct the speaker positioning error.

The apparatus may further comprise: means for generating a speaker correction factor based on the difference between the directional component and the expected location of the at least one speaker.

The apparatus may comprise means for applying the speaker correction factor during operation of the multi-speaker system such to correct the audio positioning of the at least one speaker, wherein the means for applying the speaker correction factor may comprise means for parameterising an audio signal to be output into an audio signal comprising location components; and means for synthesising an audio signal to be output by the at least one speaker in the multi-speakers based on the location components of the audio signal to be output and the speaker correction factor associated with the at least one speaker.

The apparatus may further comprise means for transmitting the speaker correction factor to the multi-speaker system for correcting the location of the at least one speaker towards the expected location of the at least one speaker.

The apparatus may further comprise: means for comparing a power/volume level associated with the at least two output signals and an expected power/volume level of the at least one audio signal to be output by the at least one speaker for the multi-speaker system; means for determining whether the at least one speaker is at least one of: missing; not connected; incorrectly connected, based on the comparison.

The means for determining a directional component associated with the at least two output signals may comprise means for generating more than one directional component; and means for comparing the directional component with an expected location of the at least one speaker may comprise means for comparing each directional component with an expected location of at least two speakers to determine whether the relative location of at least two of the speakers is correct.

According to a fourth aspect there is provided an apparatus comprising: means for receiving a speaker correction factor for correcting the location of the at least one speaker of a multi-speaker system towards an expected location of at least one speaker; and means for generating an audio signal to be output by the multi-speakers based on the speaker correction factor.

The means for generating an audio signal to be output by the multi-speakers based on the speaker correction factor may comprise: means for parameterising an audio signal to be output into an audio signal comprising location components; and means for synthesising an audio signal to be output by at least one speaker in the multi-speakers based on the location components of the audio signal to be output and the speaker correction factor associated with the at least one speaker.

The apparatus may further comprise means for determining an expected location of the at least one speaker.

Determining an expected location of the at least one speaker may comprise: means for determining a speaker configuration; and means for determining an expected location of the at least one speaker from the speaker configuration.

The means for determining an expected location of the at least one speaker from the speaker configuration comprises at least one of: means for selecting an expected location of a speaker from the speaker configuration which has the smallest difference when comparing the directional component with the expected location of the speaker; means for selecting an expected location from the speaker configuration according a defined order of selection in the speaker configuration; and means for selecting an expected location of a speaker from the speaker configuration based on a user interface input.

According to a fifth aspect there is provided an apparatus comprising: a test signal generator configured to generate at least one audio signal to be output by at least one speaker for a multi-speaker system; at least two microphones configured to provide at least two output signals based on the at least one acoustic wave output by the at least one speaker in response to the at least one audio signal; an audio signal analyser configured to determine a directional component associated with the at least two output signals; and a calibration processor configured to compare the directional component with an expected location of the at least one speaker.

The calibration processor may further be configured to: determine a speaker positioning difference when the directional component associated with the at least two speaker signals differs with the expected location; and generate a speaker positioning error message to be displayed.

The calibration processor may be configured to generate a message comprising at least one of: speaker identification associated with the at least one speaker; an error value associated with the speaker positioning error; and correction information to correct the speaker positioning error.

The calibration processor may further be configured to generate a speaker correction factor based on the difference between the directional component and the expected location of the at least one speaker.

The apparatus may comprise an audio output processor configured to apply the speaker correction factor during operation of the multi-speaker system such to correct the audio positioning of the at least one speaker, wherein the audio output processor may be configured to parameterise an audio signal to be output into an audio signal comprising location components; and configured to synthesise an audio signal to be output by the at least one speaker in the multi-speakers based on the location components of the audio signal to be output and the speaker correction factor associated with the at least one speaker.

The apparatus may further comprise a transmitter configured to transmit the speaker correction factor to the multi-speaker system for correcting the location of the at least one speaker towards the expected location of the at least one speaker.

The apparatus may further comprise: a level detector configured to determine a power/ring a power/volume level associated with the at least two output signals and an expected power/volume level of the at least one audio signal to be output by the at least one speaker for the multi-speaker system, and to determine whether the at least one speaker is at least one of: missing; not connected; incorrectly connected, based on the comparison.

The audio signal analyser may comprise a multi-directional generator configured to generate more than one directional component; and the calibration processor may be configured to compare each directional component with an expected location of at least two speakers to determine whether the relative location of at least two of the speakers is correct.

According to a sixth aspect there is provided an apparatus comprising: an input configured to receive a speaker correction factor for correcting the location of the at least one speaker of a multi-speaker system towards an expected location of at least one speaker; and an audio signal processor configured to generate an audio signal to be output by the multi-speakers based on the speaker correction factor.

The audio signal processor may be configured to: parameterise an audio signal to be output into an audio signal comprising location components; and synthesise an audio signal to be output by at least one speaker in the multi-speakers based on the location components of the audio signal to be output and the speaker correction factor associated with the at least one speaker.

The apparatus may further comprise a speaker location determiner configured to determine an expected location of the at least one speaker.

The speaker location determiner may comprise: a speaker configuration determiner configured to determine a speaker configuration; and a configuration speaker location selector configured to determining an expected location of the at least one speaker from the speaker configuration.

The configuration speaker location selector may be configured to select the expected location by at least one of: select the expected location of the speaker from the speaker configuration which has the smallest difference when comparing the directional component with the expected location of the speaker; select an expected location from the speaker configuration according a defined order of selection in the speaker configuration; and select an expected location of a speaker from the speaker configuration based on a user interface input.

According to a seventh aspect there is provided a method comprising: generating at least one audio signal to be output by at least one speaker for a multi-speaker system; receiving at least two output signals, the at least two output signals provided by at least two microphones and based on the at least one acoustic wave output by the at least one speaker in response to the at least one audio signal; determining a directional component associated with the at least two output signals; and comparing the directional component with an expected location of the at least one speaker.

The method may further comprise: determining a speaker positioning difference when the directional component associated with the at least two speaker signals differs with the expected location; and generating a speaker positioning error message to be displayed.

Generating a speaker positioning error message to be displayed may comprise generating a message comprising at least one of: speaker identification associated with the at least one speaker; an error value associated with the speaker positioning error; and correction information to correct the speaker positioning error.

The method may further comprise: generating a speaker correction factor based on the difference between the directional component and the expected location of the at least one speaker.

The method may comprise applying the speaker correction factor during operation of the multi-speaker system such to correct the audio positioning of the at least one speaker, wherein applying the speaker correction factor may comprise: parameterising an audio signal to be output into an audio signal comprising location components; and synthesising an audio signal to be output by the at least one speaker in the multi-speakers based on the location components of the audio signal to be output and the speaker correction factor associated with the at least one speaker.

The method may further comprise transmitting the speaker correction factor to the multi-speaker system for correcting the location of the at least one speaker towards the expected location of the at least one speaker.

The method may further comprise: comparing a power/volume level associated with the at least two output signals and an expected power/volume level of the at least one audio signal to be output by the at least one speaker for the multi-speaker system; and determining whether the at least one speaker is at least one of: missing; not connected; incorrectly connected, based on the comparison.

Determining a directional component associated with the at least two output signals may comprise generating more than one directional component; and comparing the directional component with an expected location of the at least one speaker may comprise comparing each directional component with an expected location of at least two speakers to determine whether the relative location of at least two of the speakers is correct.

According to an eighth aspect there is provided a method comprising: receiving a speaker correction factor for correcting the location of the at least one speaker of a multi-speaker system towards an expected location of at least one speaker; and generating an audio signal to be output by the multi-speakers based on the speaker correction factor.

Generating an audio signal to be output by the multi-speakers based on the speaker correction factor may comprise: parameterising an audio signal to be output into an audio signal comprising location components; and synthesising an audio signal to be output by at least one speaker in the multi-speakers based on the location components of the audio signal to be output and the speaker correction factor associated with the at least one speaker.

The method may further comprise determining an expected location of the at least one speaker.

Determining an expected location of the at least one speaker may comprise: determining a speaker configuration; and determining an expected location of the at least one speaker from the speaker configuration.

Determining an expected location of the at least one speaker from the speaker configuration comprises at least one of: selecting an expected location of a speaker from the speaker configuration which has the smallest difference when comparing the directional component with the expected location of the speaker; selecting an expected location from the speaker configuration according a defined order of selection in the speaker configuration; and selecting an expected location of a speaker from the speaker configuration based on a user interface input.

An apparatus may be configured to perform the method as described herein.

A computer program product may comprise program instructions to cause an apparatus to perform the method as described herein.

A method may be substantially as herein described and illustrated in the accompanying drawings.

An apparatus may be substantially as herein described and illustrated in the accompanying drawings.

A computer program product stored on a medium may cause an apparatus to perform the method as described herein.

An electronic device may comprise apparatus as described herein.

A chipset may comprise apparatus as described herein.

Embodiments of the present application aim to address problems associated with the state of the art.

SUMMARY OF THE FIGURES

For better understanding of the present application, reference will now be made by way of example to the accompanying drawings in which.

EMBODIMENTS

Figure 1:
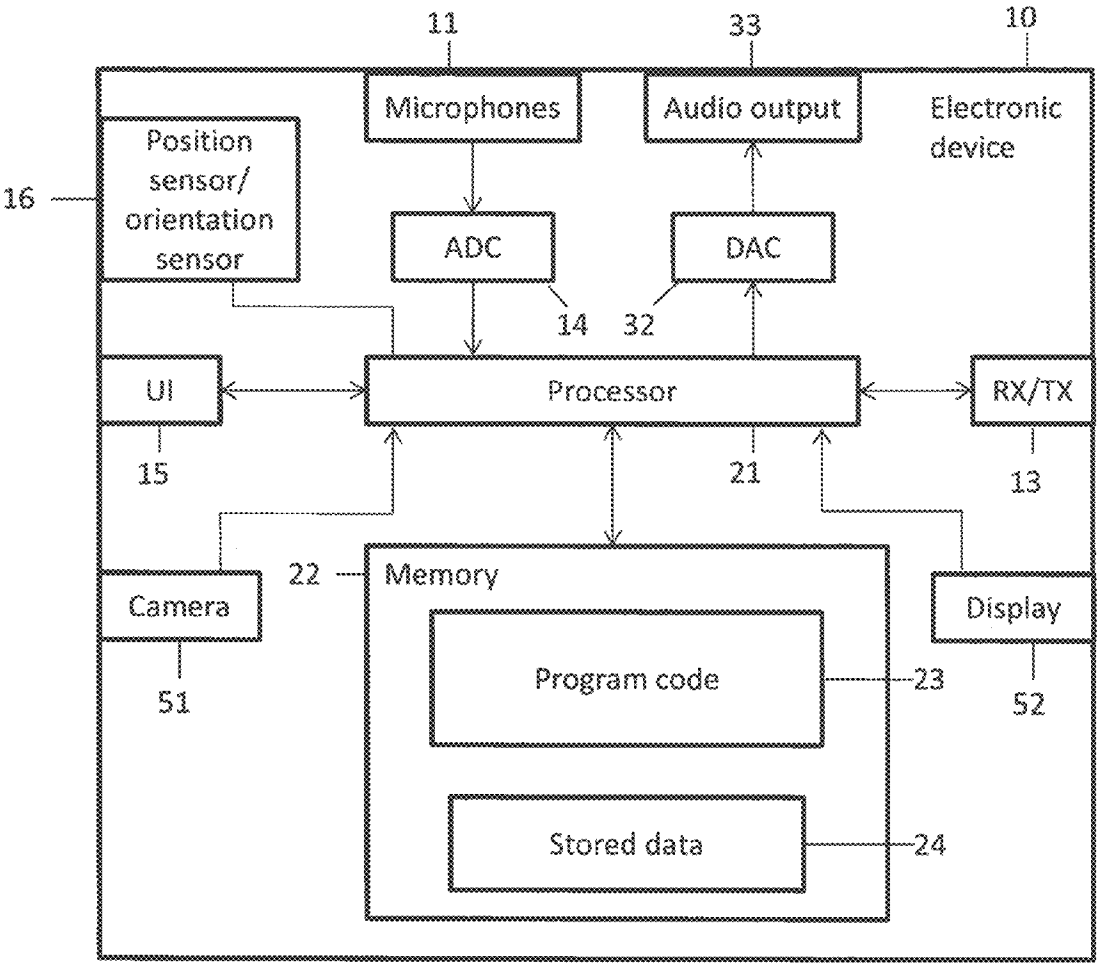
FIG. 1 shows schematically an audio capture and listening system which may encompass embodiments of the application.

The following describes in further detail suitable apparatus and possible mechanisms for the provision of effective speaker positioning compensation for audio playback apparatus. In the following examples audio signals and processing is described. However it would be appreciated that in some embodiments the audio signal/audio capture and processing is a part of an audio video system.

The concept of this application is related to assisting in the production of immersive audio playback equipment.

As discussed herein the locations of the speakers of home systems are typically defined by the room size, furniture, location of the TV/whiteboard, leading to the distances and angles of the speakers varying from the ideal or defined values and producing poor playback experiences.

It is known that some home theatre amplifiers provide methods for adjusting the volume levels of the speakers at the preferred listening position or for several positions. This is generally done by positioning a microphone at the listening positions, and by playing a test sequence in turn from each speaker. In a similar manner channel delays and phase and polarity errors in wiring can also be detected using known test sequences. In some configurations frequency responses from each speaker to the listening position can be adjusted based on the frequency response or impulse response of the measured signals. The amplifier can then use these adjustments when playing back audio content.

Although the above described approaches are able to measure distances of the speakers from the listener by timing the delay between outputting a test sequence and the microphone generating a recorded audio signal, the spacing or actual speaker directions are not known and not calibrated. This lack of directionality is generally not a significant problem with synthetic audio content (for example movies), as the sound tracks have been generated manually by an audio engineer, and are generally based on amplitude panning of audio signals between channels, and it may not even be expected that sound sources should be heard exactly from certain direction. However with natural spatial audio capture this can be a problem.

The concept of the embodiments described herein is to apply spatial audio capture apparatus to record or capture the spatial audio environment around the listener and in particular a series of defined test sequences from the speakers. The spatial capture apparatus results can then be analysed to determine the directions of the sound sources, from the defined test sequences, synthesize a multichannel output, and compare this against the 'known' or reference directions of the loudspeakers.

This comparison can for example in some embodiments be used to generate a 'difference' image or indicator to show the operator or user of the apparatus where to move the speakers to obtain a better spatial audio playback configuration.

The analysis of the spatial audio capture results when compared against a 'reference' speaker location distribution around the device can further be used to generate parameters which can be employed by the playback device, for example the home theatre amplifier or in some embodiments an apparatus or electronic device coupled to the home theatre amplifier or receiver in order that the multichannel playback is adjusted accordingly. In some embodiments the analysis and playback parts can be performed completely independently using separate apparatus, or in some embodiments the same apparatus. In some embodiments the analysis part can be performed every time before initiating a new playback session.

In the following description the embodiments described herein show a first apparatus comprising spatial capture, analysis, and calibration parts which can be coupled to a second apparatus comprising playback parts. For example the sound capture, analysis and calibration parameters can be generated within an apparatus separate from the playback apparatus which can employ the calibration parameters to compensate for non-ideal speaker configurations for all input audio signals (and not just the audio signals from the first apparatus). However it would be understood that in some embodiments the playback apparatus comprises the analysis parts and receives from a 'coupled' device the recorded audio signals from the microphones and in some other embodiments other sensor information (such as microphone directional, motion, visual or other information). Furthermore in some embodiments the first apparatus can comprise at least partially the playback apparatus, for example the first apparatus can generate a suitably calibrated compensated audio signal to a multichannel audio system with non-ideal speaker location configuration. Thus in some embodiments it can be possible for at least two of the 'first' apparatus desiring to listen to an audio signal at different positions to output suitably calibrated compensated audio signals for their unique listening location.

FIG. 1 shows a schematic block diagram of an exemplary apparatus or electronic device 10, which may be implemented as a first apparatus to record, and in some embodiments analyse and in some embodiments generate or apply suitable calibration parameters for audio playback compensation. Furthermore in some embodiments the apparatus or electronic device can function as an audio source or audio playback apparatus. It would be understood that in some embodiments the same apparatus can be configured or re-configured to operate as both analyzer and playback apparatus passing a multichannel audio signal to a suitable amplifier or multichannel system to be output.

The apparatus 10 may for example be a mobile terminal or user equipment of a wireless communication system. In some embodiments the apparatus can be an audio player or audio recorder, such as an MP3 player, a media recorder/player (also known as an MP4 player), or any suitable portable apparatus suitable for recording audio or audio/video camcorder/memory audio or video recorder.

The apparatus 10 can in some embodiments comprise a microphone or array of microphones 11 for spatial audio signal capture. In some embodiments the microphone or array of microphones can be a solid state microphone, in other words capable of capturing audio signals and outputting a suitable digital format signal. In some other embodiments the microphone or array of microphones 11 can comprise any suitable microphone or audio capture means, for example a condenser microphone, capacitor microphone, electrostatic microphone, electret condenser microphone, dynamic microphone, ribbon microphone, carbon microphone, piezoelectric microphone, or micro electrical-mechanical system (MEMS) microphone. In some embodiments the microphone 11 is a digital microphone array, in other words configured to generate a digital signal (and thus not requiring an analogue-to-digital converter). The microphone 11 or array of microphones can be configured to capture or record acoustic waves from different locations or orientations. In some embodiments the microphone or microphone array recording or capture location/orientation configuration can be changed, however in some embodiments the microphone or microphone array recording or capture location/orientation configuration is fixed. In some embodiments the microphone or microphone array recording or capture location/orientation configuration is known and output to the processor or pre-configured and stored in memory to be recovered by the processor. The microphone 11 or array of microphones can in some embodiments output the audio captured signal to an analogue-to-digital converter (ADC) 14.

In some embodiments the apparatus can further comprise an analogue-to-digital converter (ADC) 14 configured to receive the analogue captured audio signal from the microphones and outputting the audio captured signal in a suitable digital form.

The analogue-to-digital converter 14 can be any suitable analogue-to-digital conversion or processing means. In some embodiments the microphones are 'integrated' microphones containing both audio signal capturing and analogue-to-digital conversion capability.

In some embodiments the apparatus 10 further comprises a digital-to-analogue converter 32 for converting digital audio signals from a processor 21 to a suitable analogue format. The digital-to-analogue converter (DAC) or signal processing means 32 can in some embodiments be any suitable DAC technology.

Furthermore the audio subsystem can comprise in some embodiments an audio output 33. The audio output 33 can in some embodiments receive the output from the digital-to-analogue converter 32 and present the analogue audio signals to an amplifier or suitable audio presentation means such as a home theatre/home cinema amplifier/receiver and multichannel speaker set. Although in the embodiments shown herein the apparatus outputs the audio signals to a separate audio presentation apparatus in some embodiments the apparatus further comprises the separate audio presentation apparatus.

Furthermore as discussed herein although the apparatus 10 is shown having both audio capture for calibration and audio playback and output components, it would be understood that in some embodiments the apparatus 10 can comprise one or the other of the audio capture and audio playback and output component.

In some embodiments the apparatus 10 comprises a processor 21. The processor 21 is coupled to the audio subsystem and specifically in some examples the analogue-to-digital converter 14 for receiving digital signals representing audio signals from the microphone 11, and the digital-to-analogue converter (DAC) 12 configured to output processed digital audio signals. The processor 21 can be configured to execute various program codes. The implemented program codes can comprise for example audio capture or recording, audio analysis and audio calibration processing and audio playback routines. In some embodiments the program codes can thus be configured to perform speaker non-ideal placement compensation.

In some embodiments the apparatus further comprises a memory 22. In some embodiments the processor is coupled to memory 22. The memory can be any suitable storage means. In some embodiments the memory 22 comprises a program code section 23 for storing program codes implementable upon the processor 21. Furthermore in some embodiments the memory 22 can further comprise a stored data section 24 for storing data, for example data that has been encoded in accordance with the application or data to be encoded via the application embodiments as described later. The implemented program code stored within the program code section 23, and the data stored within the stored data section 24 can be retrieved by the processor 21 whenever needed via the memory-processor coupling.

In some further embodiments the apparatus 10 can comprise a user interface 15. The user interface 15 can be coupled in some embodiments to the processor 21. In some embodiments the processor can control the operation of the user interface and receive inputs from the user interface 15. In some embodiments the user interface 15 can enable a user to input commands to the electronic device or apparatus 10, for example via a keypad, and/or to obtain information from the apparatus 10, for example via a display 52. The display 52 can in some embodiments comprise a touch screen or touch interface capable of both enabling information to be entered to the apparatus 10 and therefore operating as a user interface input and further displaying information to the user of the apparatus 10. For example as described herein in further detail information to the user of the apparatus of a non-ideal placement of speaker and potential speaker movement to correct the non-ideal placement with respect to a 'listening' position.

In some embodiments the apparatus further comprises a transceiver 13, the transceiver in such embodiments can be coupled to the processor and configured to enable a communication with other apparatus or electronic devices, for example via a wireless communications network. The transceiver 13 or any suitable transceiver or transmitter and/or receiver means can in some embodiments be configured to communicate with other electronic devices or apparatus via a wire or wired coupling. For example in some embodiments audio signals to be output are passed to the transceiver for wirelessly outputting.

The transceiver 13 can communicate with further apparatus by any suitable known communications protocol, for example in some embodiments the transceiver 13 or transceiver means can use a suitable universal mobile telecommunications system (UMTS) protocol, a wireless local area network (WLAN) protocol such as for example IEEE 802.X, a suitable short-range radio frequency communication protocol such as Bluetooth, or infrared data communication pathway (IRDA).

In some embodiments the apparatus comprises a position sensor 16 configured to estimate the position of the apparatus 10. The position sensor 16 can in some embodiments be a satellite positioning sensor such as a GPS (Global Positioning System), GLONASS or Galileo receiver.

In some embodiments the positioning sensor can be a cellular ID system or an assisted GPS system.

In some embodiments the apparatus 10 further comprises a direction or orientation sensor. The orientation/direction sensor can in some embodiments be an electronic compass, accelerometer, and a gyroscope or be determined by the motion of the apparatus using the positioning estimate.

In some embodiments the apparatus 10 comprises a camera or imaging means configured to generate images from the apparatus environment. For example as described herein in some embodiments the camera can be configure to capture or record a visual image which can be used to define the direction or orientation of the apparatus relative to an external feature, such as a television, cinema display, or speaker.

It is to be understood again that the structure of the electronic device 10 could be supplemented and varied in many ways.

Figure 2A:
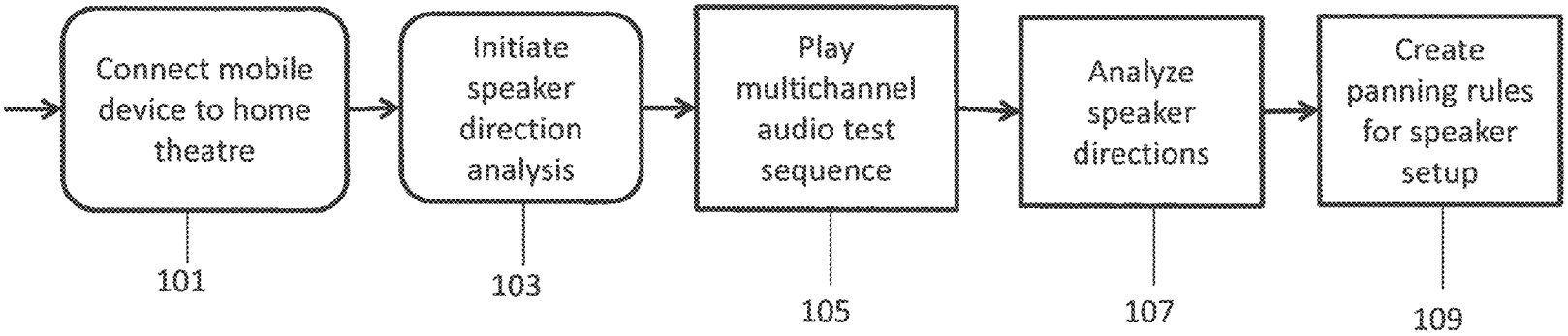
FIG. 2*a* shows schematically an example overview of calibration according to some embodiments.
Figure 2B:
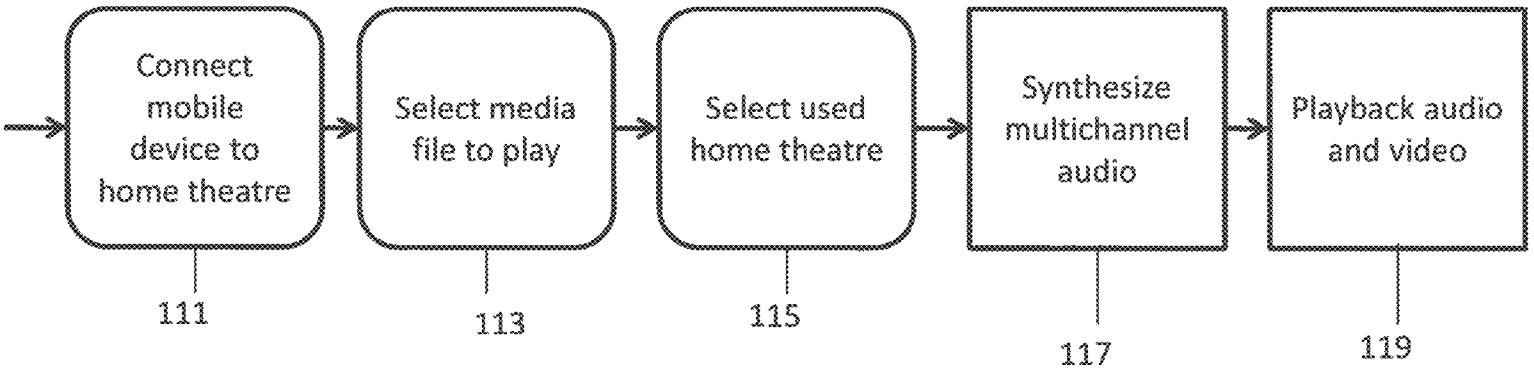
FIG. 2*b* shows schematically an example overview of playback according to some embodiments.

With respect to FIGS. 2*a* and 2*b* is shown an overview of the use of the apparatus as described herein for speaker configuration analysis (FIG. 2*a*) and speaker calibration in playback (FIG. 2*b*).

Thus in some embodiments the apparatus or mobile device is connected to a home theatre system comprising the multichannel speaker system. In some embodiments the connection or coupling can be for example a cable (such as a HDMI connection) or a wireless connection (such as Bluetooth).

The operation of connecting the mobile device to the home cinema system is shown in FIG. 2*a* by step 101.

Furthermore the apparatus or mobile device can be located or moved to the desired listening location. In some embodiments the apparatus or mobile device can, for example via the UI or display, instruct or indicate to a user how to hold the device. For example in some embodiments the apparatus or mobile device monitors the position or location of the apparatus and indicates to the user how the apparatus or device should be hold such that it is pointing directly to the 'front'. The 'front' location is typically is a TV screen or similar. Thus in some embodiments by using images from the camera image tracking can be used to determine when the apparatus is positioned or orientated in the desired or correct way.

In some embodiments the apparatus monitors the motion of the apparatus, for example by using the position/orientation sensor information, image tracking or motion sensor to verify that the apparatus or mobile device is being held in a stable position. If the apparatus is not stable, the process is interrupted and the user is instructed to restart the process. The device initiates speaker direction analysis application.

The operation of initiating the speaker directional analysis is shown in FIG. 2*a* by step 103.

In some embodiment the apparatus or mobile device can be configured to play or output a multichannel audio test sequence, which typically includes sounds from every individual speaker in a sequence (one by one).

The operation of playing the multichannel audio test is shown in FIG. 2*a* by step 105.

Using the three (or more) microphones in the mobile device, the apparatus or mobile device can then record and analyse firstly, whether the speaker is connected to the system at all and secondly, the direction of individual speakers in relation to the apparatus or mobile device. If it is noticed that in some embodiments where at least one of the speakers is missing from the system the user is informed and the operation is interrupted.

The operation of analysing the speaker directions is shown in FIG. 2*a* by step 107.

Otherwise, the apparatus or mobile device in some embodiments creates room specific panning rules which can be later used for playing back multichannel content in this particular home theatre setup.

The operation of generating or creating room specific panning rules is shown in FIG. 2*a* by step 109.

With respect to FIG. 2*a* an overview of the operations for audio playback according to some embodiments is shown.

Thus in some embodiments the apparatus or mobile device is connected to a home theatre system comprising the multichannel speaker system. In some embodiments the connection or coupling can be for example a cable (such as a HDMI connection) or a wireless connection (such as Bluetooth).

The operation of connecting the apparatus or mobile device to the home theatre system is shown in FIG. 2*b* by step 111.

In some embodiments the apparatus or mobile device (or the user of the apparatus) selects the media file to be played. In some embodiments the selection can be made by a user interface 15 input.

It would be understood that in some embodiments the media file to be played comprises a multichannel audio signal or file(s) which are stored or received by the apparatus or mobile device a format which enables playback modification.

In some embodiments the multichannel audio signal comprises a 'normal' multichannel audio signal or content which is converted into a format which enables playback modification. In some embodiments the media files can be captured using the apparatus or mobile device or copied or retrieved or downloaded from other sources.

The operation of selecting a media file to be played is shown in FIG. 2*b* by step 113.

In some embodiments the apparatus or mobile device can be configured to select one of the playback setups saved on the apparatus or mobile device (or in some embodiments the apparatus or mobile device can perform a calibration/test by playing the test sequence). Thus in some embodiments the apparatus or mobile device can have stored on it multiple possible position settings to produce or retrieve audio calibration settings for the selected or detected position within the multichannel speaker system. In other words in some embodiments the apparatus may be further caused to determine an expected location at least one speaker (to be tested). Thus in some embodiments determining an expected location of the at least one speaker can cause the apparatus to determine a speaker configuration (such as a defined or predefined configuration) and then determine or select an expected location of the at least one speaker from the speaker configuration. The determining or selecting of an expected location of the at least one speaker from the speaker configuration can further cause the apparatus to perform selecting an expected location of a speaker from the speaker configuration which has the smallest difference when comparing the directional component with the expected location of the speaker (in other words selecting a location which is closest to a 'heard direction. In some embodiments the expected location of the speaker can be the selection of an expected location from a defined speaker configuration according a defined order of selection in the speaker configuration (in other word the test signals are generated according to a known selection). In some embodiments the selection or determination of the expected position can be performed based on a user input selecting an expected location of a speaker from the speaker configuration.

The operation of selecting a playback setup or used home theatre is shown in FIG. 2*b* by step 115.

It would be understood that the order of the previous two operations can be also changed, in other words the playback setup is selected and then the media file is selected.

The apparatus can in some embodiments by using the information of the speaker location or directions from the earlier test operations can be configured to process the media file such that the apparatus or mobile device synthesizes a suitable multichannel (such as a 5.1 channel audio stream) output.

The operation of synthesising the multichannel audio signal is shown in FIG. 2*b* by step 117.

The multichannel audio signal can then be output to the speakers. In some embodiments the playback of the audio and optionally video on a suitable display is performed.

The operation of playing the audio and video is shown in FIG. 2*b* by step 119.

The playback of the audio is such that the directions of the sound sources within the media files are heard to come from the 'correct' directions rather than the directions caused by the non-ideal location of the speakers. The correction of the sound sources in such embodiments as described in the method herein and described in further detail hereafter is a significant improvement over existing systems because the sound sources can be synthesized to correct directions even though the speaker positions are not ideal. The benefit for the user of such systems according to these embodiments is that they can relive captured moments or alternatively experience movie tracks as they are intended.

In some embodiments, the correction of the sound sources can be performed in the home theatre equipment which has been equipped with such correction functionality. The correction parameters can be defined by an external apparatus such as mobile device.

Figure 3:
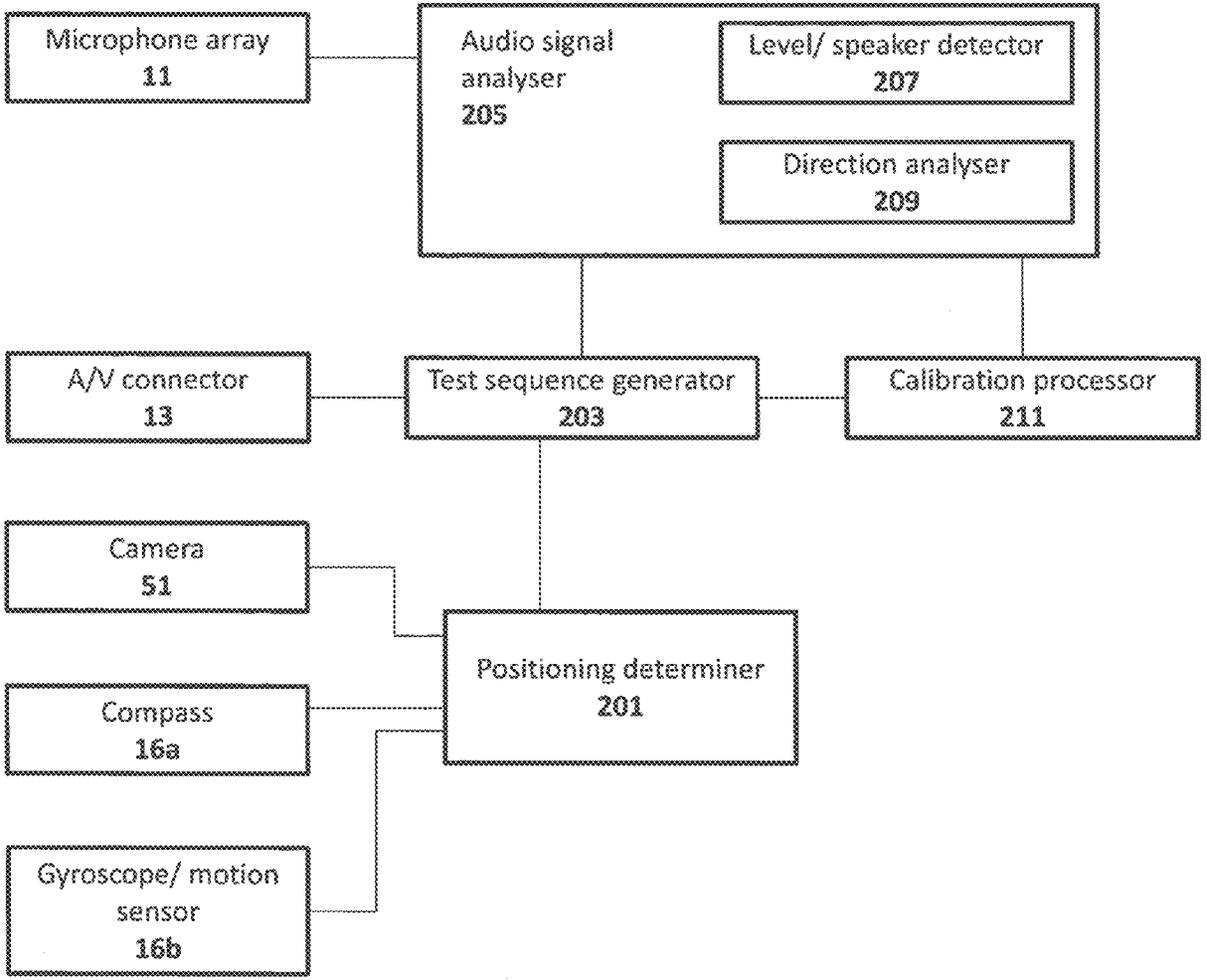
FIG. 3 shows schematically an example calibration apparatus according to some embodiments.

With respect to FIG. 3 an example apparatus is shown in further detail from the perspective of the test or calibration apparatus components.

Furthermore with respect to FIGS. 4, 5, 6, 9 and 10 the method of performing the calibration or test as described in overview in FIG. 2*a* is described in further detail.

In some embodiments the apparatus comprises a positioning determiner 201 or suitable means for determining a position/orientation of the apparatus. The positioning determiner 201 can in some embodiments be configured to receive information from the camera 51, and/or motion/location/position estimation sensors. For example in some embodiments the positioning determiner 201 can be configured to receive information from sensors such as a compass 16*a*, or gyroscope/motion sensor 16*b*.

In some embodiments the positioning determiner 201 can be configured to receive the inputs and determine whether the apparatus is positioned correctly.

The positioning determiner 201 can for example receive image data from the camera 51 and determine whether the apparatus is positioned or pointed towards a 'central' or 'desired' feature or location, such as a cinema screen, display panel, or centre speaker and furthermore monitor whether the apparatus is stationary or moving relative to the feature.

Similarly the position determiner 201 can determine using the compass information whether the position is drifting/changing and whether the position is correct. In some embodiments the positioning determiner 201 can receive a user interface input or control output indicating an apparatus is located 'correctly' and store the camera image or sensor value as a reference value to compare against.

Thus for example the position determiner can compare the reference value and determine whether the apparatus moves or drifts from this desired position and if so whether the motion or drift is greater than a defined threshold value and generate a motion or drift alert.

The positioning determiner 201 can in some embodiments output the motion or drift alert to the test sequence generator 203.

As described herein in some embodiments the apparatus comprises an audio/video (A/V) connector (for example the audio output 33 or transceiver 13). In some embodiments the A/V connector 13 is configured to be coupled to a test sequence generator 203 and be configured to provide an indication of whether the A/V connector 13 is correctly connected to a multichannel audio system such as a home theatre system. For example where the A/V connector is a HDMI cable (or socket configured to receive a HDMI cable coupling the apparatus and a multichannel audio system) the A/V connector 13 can be configured to indicate to the test sequence generator 203 information of when the HDMI cable is connected to a multichannel audio system.

In some embodiments the apparatus comprises a test sequence generator 203. The test sequence generator 203 can be configured to perform a pre-test initialisation sequence. The pre-test initialisation sequence can for example be to check or determine whether the apparatus is coupled to a multichannel audio system. This can for example be determined by monitoring the A/V connector 13 input. Furthermore the test sequence generator 203 can in some embodiments be configured to determine whether the apparatus is positioned correctly. The test sequence generator 203 can determine whether the apparatus is position correctly by the information passed by the positioning determiner 201.

In some embodiments the test sequence generator 203 can interrupt the test or pause the test where the apparatus is not positioned correctly or coupled to the home theatre or multichannel audio system (or where coupling has been lost or where the position has drifted).

Figure 4:
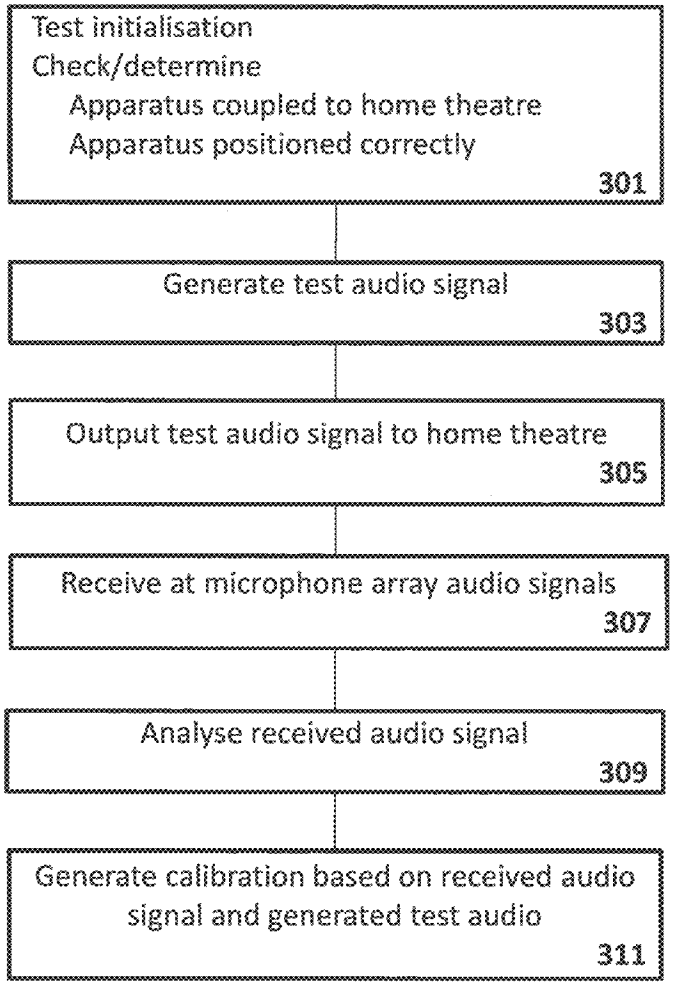
FIG. 4 shows a flow diagram of the operation of the example calibration apparatus according to some embodiments.

The operation of the initialisation test where it is determined whether the apparatus is coupled to the multichannel audio systems such as a home theatre system and whether the apparatus is correctly positioned is shown in FIG. 4 by step 301.

In some embodiments the test sequence generator 203 can be configured to generate a test sequence audio signal. For example in some embodiments the test sequence is a signal passed to each channel in turn. For example an audio signal which can be single tone, multi-tone, or any suitable audio signal can be output to the multichannel audio system via the A/V connector 13. In some embodiments the test sequence generator 203 is configured to generate a suitable audio signal and output it to each channel individually in a rotating sequence. Thus for example a 5.1 channel audio system test sequence can be an audio signal repeated and sent in the order of front centre (FC) channel, front right (FR) channel, rear right (RR) channel, rear left (RL) channel, and front left (FL) channel. It would be understood that in some embodiments any suitable output order and any suitable output combination of channels can be used in the test audio sequence.

The generation of the test audio signal is shown in FIG. 4 by step 303.

The test sequence generator 203 can then output the test sequence to the multichannel audio via the A/V connector 13.

The operation of outputting the test audio signal to the home theatre system is shown in FIG. 4 by step 305.

In some embodiments the apparatus comprises an audio signal analyser 205.

The audio signal analyser 205 can in some embodiments be configured to receive audio signals from the microphone array 11 and furthermore an indication of the test sequence from the test sequence generator 203. In some embodiments the microphone array 11 comprises three microphones, however it would be understood that in some embodiments more or fewer microphones can be used. It would be understood that in some embodiments, for example where the microphones are not physically coupled to the apparatus (for example mounted on a headset separate from the recording apparatus) that the orientation sensor or determination can be further located on the microphones, for example with a sensor in the headset and this information is transmitted or passed to the positioning determiner and/or direction analyser.

In some embodiments the audio signal analyser 205 can be configured to receive an indicator from the test sequence generator 203 that a test sequence audio signal has been output and the analyser is to analyse the incoming audio signals from the microphone array 11.

The operation of receiving at the microphone array the audio signals is shown in FIG. 4 by step 307.

The audio signal analyser 205 can be is configured to receive the audio signals from the microphone array and analyse the received audio signals.

In some embodiments the audio signal analyser 205 comprises a level/speaker detector 207 configured to receive the audio signals and determine a signal level such as power level (or volume or amplitude) value from the microphone arrays to determine whether a speaker exists or has output a signal. The level/speakers detector 207 can thus in some embodiments be configured to determine whether or not a speaker is missing or disconnected or wired incorrectly in some way. Thus in some embodiments the level/speaker detector 207 can be configured to provide information to avoid false directional analysis where the direction analyser determines a direction for an audio source which is not from the speaker but general background noise.

In some embodiments the audio signal analyser 205 comprises a direction analyser 209 configured to receive the audio signals from the microphone array and determine a direction or relative orientation to the apparatus of dominant audio sources within the environment. Where the level/speaker detector 207 has determined that a speaker has output a specific volume level threshold then the direction analyser 209 can generate a direction analysis result which indicate the direction from which the audio signal has been received and furthermore that the audio signal received is generated by the test sequence signal and not some background or random noise.

The operation of analysing the received audio signals is shown in FIG. 4 by step 309.

The audio signal analyser 205 can output the analysis of the audio signal to a calibration processor 211.

With respect to FIG. 4 the operation of the direction analyser 209 is described. In some embodiments the direction analyser 209 is configured to receive not only the audio signals from the microphone but also the microphone array orientation information. The orientation information can be generated in some embodiments by the positioning determiner processing the sensor information (such as image data, compass, motion sensor, gyroscope etc.) and can be according to any suitable format. For example in some embodiments the orientation information can be in the form of an orientation parameter. The orientation parameter can be represented in some embodiments by a floating point number or fixed point (or integer) value. Furthermore in some embodiments the resolution of the orientation information can be any suitable resolution. For example, as it is known that the resolution of human auditory system in its best region (in front of the listener) is about ~1 degree the orientation information (azimuth) value can be an integer value from 0 to 360 with a resolution of 1 degree. However it would be understood that in some embodiments a resolution of greater than or less than 1 degree can be implemented. In some embodiments the audio signal analyser and direction analyser 209 is not configured to receive positional information updates of the apparatus but determine positional information of the audio signals in the environment relative to the microphone orientations (and thus relative to the apparatus).

The direction analyser 209 can be configured to receive the audio signals generated by the microphone array 11.

Figure 5:
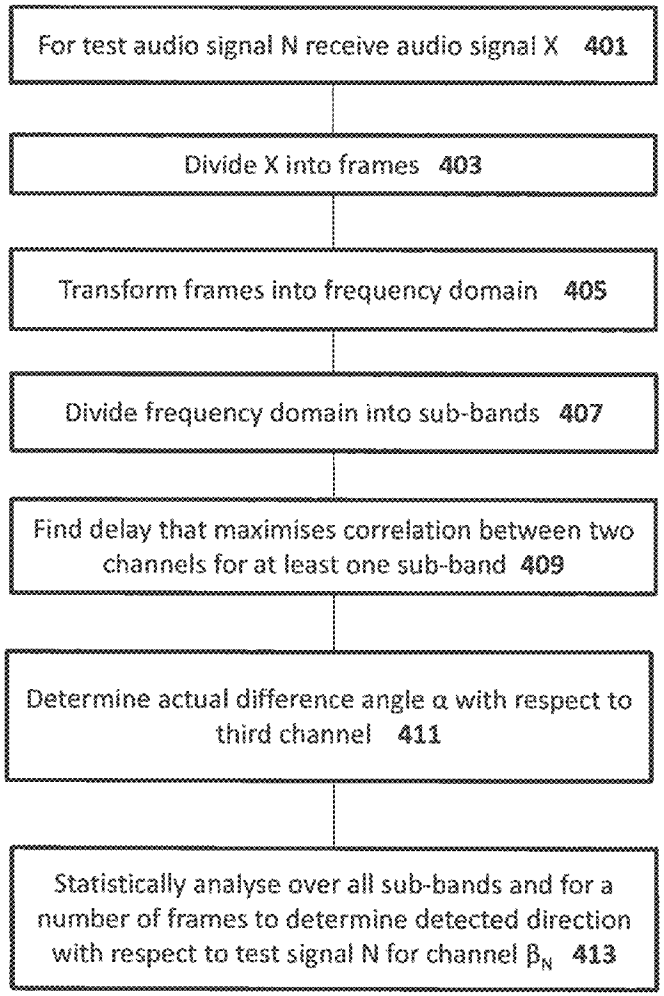
FIG. 5 shows a flow diagram of the directional analysis within calibration operations as shown in FIG. 4 according to some embodiments.

The operation of receiving the audio signal X for the test audio signal N is shown in FIG. 5 by step 401.

For example in some embodiments the direction analyser 209 can be configured to process the audio signals generated from the microphones to determine spatial information from the audio signal. For example in some embodiments the direction analyser 209 can be configured to determine from the audio signal a number of audio sources from which a significant portion of the audio signal energy is generated and determine the source directions.

An example direction analysis of the audio signal is described as follows. However it would be understood that any suitable audio signal direction analysis in either time or other representational domain (frequency domain etc.) can be used.

In some embodiments the direction analyser 209 comprises a framer. The framer or suitable framer means can be configured to receive the audio signals from the microphones and divide the digital format signals into frames or groups of audio sample data. In some embodiments the framer can furthermore be configured to window the data using any suitable windowing function. The framer can be configured to generate frames of audio signal data for each microphone input wherein the length of each frame and a degree of overlap of each frame can be any suitable value. For example in some embodiments each audio frame is 20 milliseconds long and has an overlap of 10 milliseconds between frames. The framer can be configured to output the frame audio data to a Time-to-Frequency Domain Transformer.

The operation of dividing the audio signal X into frames is shown in FIG. 5 by step 403.

In some embodiments the direction analyser 209 comprises a Time-to-Frequency Domain Transformer. The Time-to-Frequency Domain Transformer or suitable transformer means can be configured to perform any suitable time-to-frequency domain transformation on the frame audio data. In some embodiments the Time-to-Frequency Domain Transformer can be a Discrete Fourier Transformer (DFT). However the Transformer can be any suitable Transformer or filter bank such as a Discrete Cosine Transformer (DCT), a Modified Discrete Cosine Transformer (MDCT), a Fast Fourier Transformer (FFT) or a quadrature mirror filter (QMF). The Time-to-Frequency Domain Transformer can be configured to output a frequency domain signal for each microphone input to a sub-band filter.

The operation of transforming frames into the frequency domain is shown in FIG. 5 by step 405.

In some embodiments the direction analyser 209 comprises a sub-band filter. The sub-band filter or suitable means can be configured to receive the frequency domain signals from the Time-to-Frequency Domain Transformer for each microphone and divide each microphone audio signal frequency domain signal into a number of sub-bands.

The sub-band division can be any suitable sub-band division. For example in some embodiments the sub-band filter can be configured to operate using psychoacoustic filtering bands. The sub-band filter can then be configured to output each domain range sub-band to a direction analyser.

The operation of dividing the frequency domain into sub-bands is shown in FIG. 5 by step 407.

In some embodiments the signal can be divided into sub-bands using a filter bank structure. In some embodiments filter bank structure can be configured to operate using psychoacoustic filter banks.

In some embodiments the direction analyser 209 can comprise a direction determiner. The direction determiner or suitable means for determining the direction can in some embodiments be configured to select a sub-band and the associated frequency domain signals for each microphone of the sub-band. In some embodiments, for example where the test signal is a tonal or multi-tonal signal with defined frequency bands the selected sub-bands are those known to contain the test sequence tones.

The direction determiner can then be configured to perform directional analysis on the signals in the sub-band. The direction determiner can be configured in some embodiments to perform a cross correlation between the microphone/decoder sub-band frequency domain signals within a suitable processing means.

In some embodiments this direction analysis can therefore be defined as receiving the audio sub-band data;

$$X_k^b(n)=X_k(n_b+n),\ n=0,\ldots,n_{b+2}-n_b-1,\ b=0,\ldots,B-1$$

where $X_k$ is the frequency domain representation of input channel k and $n_b$ is the first index of bth subband. In some embodiments for every subband the directional analysis as described herein as follows.

In the direction determiner the delay value of the cross correlation is found which maximises the cross correlation of the frequency domain sub-band signals.

Mathematically the direction determiner can thus in some embodiments find the delay $\theta_b$ that maximizes the correlation between the two channels for subband b. DFT domain representation of e.g. $X_k^b(n)$ can be shifted $\tau_b$ time domain samples using $$X_{k,\tau_b}^b(n) = X_k^b(n)e^{-j\frac{2\pi n\tau_b}{N}}.$$

The optimal delay in some embodiments can be obtained from $$\underset{\tau_b}{\operatorname{argmax}}\operatorname{Re}\left(\sum_{n=0}^{n_{b+1}-n_b-1}\left(X_{2,\tau_b}^b(n)*X_3^b(n)\right)\right),\ \tau_b\in[-D_{tot},D_{tot}]$$

where Re indicates the real part of the result and * denotes complex conjugate. $X_{2,\tau_b}^b$ and $X_3^b$ are considered vectors with length of $n_{b+1}-n_b$ samples. The direction analyser can in some embodiments implement a resolution of one time domain sample for the search of the delay.

The operation of determining the delay value which maximises the correlation is shown in FIG. 5 by step 409.

This delay can in some embodiments be used to estimate the angle or represent the angle from the dominant audio signal source for the sub-band. This angle can be defined as $\alpha$. It would be understood that whilst a pair or two microphones can provide a first angle, an improved directional estimate can be produced by using more than two microphones and preferably in some embodiments more than two microphones on two or more axes.

Mathematically this can in some embodiments be generated by generating a sum signal. The sum signal can be mathematically defined as.

$$X_{sum}^b=\begin{cases}\left(X_{2,\tau_b}^b+X_2^b\right)/2 & \tau_b\le 0\\ \left(X_2^b+X_{2,-\tau_b}^b\right)/2 & \tau_b>0\end{cases}$$

In other words the a sum signal is generated where the content of the microphone channel in which an event occurs first is added with no modification, whereas the microphone channel in which the event occurs later is shifted to obtain best match to the first microphone channel.

It would be understood that the delay or shift $\tau_b$ indicates how much closer the sound source is to one microphone (or channel) than another microphone (or channel). The direction analyser can be configured to determine actual difference in distance as $$\Delta_{23} = \frac{v\tau_b}{F_s}$$

where Fs is the sampling rate of the signal and v is the speed of the signal in air (or in water if we are making underwater recordings).

The angle of the arriving sound is determined by the direction determiner as, $$d_b = \pm\cos^{-1}\left(\frac{\Delta_{23}^2 + 2b\Delta_{22} - d^2}{2db}\right)$$

where d is the distance between the pair of microphones/channel separation and b is the estimated distance between sound sources and nearest microphone. In some embodiments the direction determiner can be configured to set the value of b to a fixed value. For example b=2 meters has been found to provide stable results.

It would be understood that the determination described herein provides two alternatives for the direction of the arriving sound as the exact direction cannot be determined with only two microphones/channels.

In some embodiments the direction determiner can be configured to use audio signals from a third channel or the third microphone to define which of the signs in the determination is correct. The distances between the third channel or microphone and the two estimated sound sources are:

$$\delta_b^+ = \sqrt{(h+b\sin(d_b))^2+(d/2+b\cos(d_b))^2}$$

$$\delta_b^- = \sqrt{(h-b\sin(d_b))^2+(d/2+b\cos(d_b))^2}$$

where h is the height of an equilateral triangle (where the channels or microphones determine a triangle), i.e.

$$h = \frac{\sqrt{2}}{2}d.$$

The distances in the above determination can be considered to be equal to delays (in samples) of;

$$\tau_b^+ = \frac{\delta^+ - b}{v}F_s$$

$$\tau_b^- = \frac{\delta^- - b}{v}F_s$$

Out of these two delays the direction determiner in some embodiments is configured to select the one which provides better correlation with the sum signal. The correlations can for example be represented as $$c_b^+ = \mathrm{Re}\left(\sum_{n=0}^{n_{b+1}-n_b-1}\left(X_{sum,\tau_b^+}^b(n) * X_1^b(n)\right)\right)$$

-continued $$c_b^- = \mathrm{Re}\left(\sum_{n=0}^{n_{b+1}-n_b-1}\left(X_{sum,\tau_b^-}^b(n) * X_1^b(n)\right)\right)$$

The direction determiner can then in some embodiments then determine the direction of the dominant sound source for subband b as:

$$a_b = \begin{cases} \dot{a}_b & c_b^+ \geq c_b^- \\ -\dot{a}_b & c_b^+ < c_b^- \end{cases}.$$

In other embodiments of the invention, a person skilled in art is able to produce corresponding directional analysis operations for different signals representations, such as for filter bank transform.

The operation of determining the actual angle α is shown in FIG. 5 by step 411.

The directional analyser can then be configured to determine whether or not all of the sub-bands have been selected. Where all of the sub-bands have been selected in some embodiments then the direction analyser can be configured to output the directional analysis results. Where not all of the sub-bands have been selected then the operation can be passed back to selecting a further sub-band processing step.

In some embodiments the direction analyser can further determine the directional information for the length of the test sequence, in other words perform statistical analysis of the test results over multiple frames. For example where each frame is c20 ms in length and the test sound or audio signal is output for the output period covering 10 successive overlapping 20 ms frames, then the directional information $$\alpha_{n,b},\ n=1,\ldots,10,\ b=0,\ldots,B-1$$

where n is the number of the frame, b is the number of the subband, and B is the total number of subbands is determined. In some embodiments the direction analyser statistical analysis is performed over all $\alpha_{n,b}$ values and the most frequently occurring direction is the detected direction of the test signal, in other words the direction of channel $_N$ (for example speaker N) where the test audio signal N is from the channel $_N$ (speaker N).

The operation of performing statistical analysis is shown in FIG. 5 by step 413.

In some embodiments the apparatus comprises a calibration processor 211 configured to receive the output of the audio signal analyser 205 and furthermore the test sequence generator 203. The calibration processor 211 can be configured to perform test analysis to determine whether the speaker positioning is correct according to defined speaker location reference values. Furthermore the calibration processor 211 in some embodiments can be configured to determine whether there is the correct number of speakers within the system, and whether the speakers are correctly sequenced (or ordered) about the listener. In some embodiments the calibration processor 211 can be configured to generate or output calibration parameters to compensate for the non-ideal speaker positions. However in some embodiments the calibration processor 211 can be configured to generate (and display) indicators showing to the user how to reposition the speakers, or that the speakers are incorrectly positioned.

Figure 6:
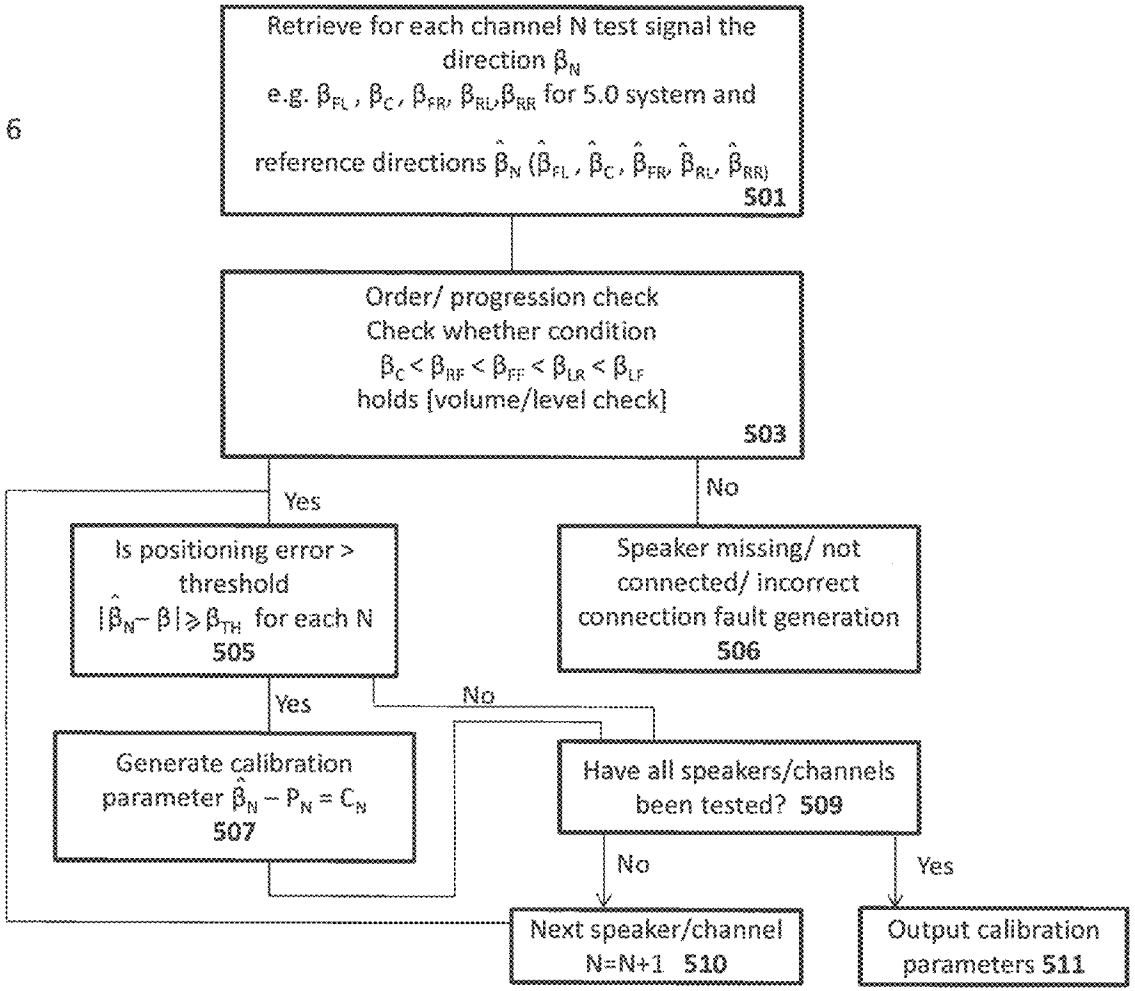
FIG. 6 shows a flow diagram of the calibration checks within calibration operations as shown in FIG. 4 according to some embodiments.

With respect to FIG. 6 the operation of the calibration processor 211 according to some embodiments is shown in further detail.

In some embodiments the calibration processor 211 can be configured to retrieve or receive for each channel k the test signal direction analysis $_N$ (the estimated direction of speaker N according to the analysis).

The operation of retrieving the estimated direction for each channel in the test signal is shown in FIG. 6 step 501.

In some embodiments the calibration processor 211 can perform an order or progression check on the test directions for all of the speakers. The order or progression test checks whether there are any incorrectly wired speakers in the system and so would output a signal from a speaker other than the expected speaker and therefore generate a speaker progression other than the expected progression order. This can be performed in some embodiments (and within a 5.1 system) by determining whether the condition $$\beta_C<\beta_{RF}<\beta_{RR}<\beta_{LR}<\beta_{LF}$$

holds, where we assume that 2π periodicity of the signal is considered, i.e. when drawing the directions to a circle the speaker order must be correct. In other words zero radians/degrees corresponds directly to a the front orientation and the angle increases clockwise (so that directly to the right is π/2 radians, directly behind is π rad, and directly to the left is 3π/2 rad). In some embodiments a similar formulation can be achieved for anticlockwise angle determinations.

The operation of performing the calibration order or progression check is shown in FIG. 6 by step 503.

Where the order or progression check is not passed then the calibration processor 211 can in some embodiments generate a fault indicator or message to be passed to the user interface or display that there is a speaker missing or a speaker is not connected or there is an incorrect connection of a speaker. In some embodiments a missing speaker fault can be diagnosed by the level/speaker detector 207 output. The fault information can in some embodiments be passed to the user and the user then performs a physical or otherwise check of the multichannel audio system.

The operation of generating a fault message is shown in FIG. 6 by step 506.

In some embodiments where the audio progression check is passed then a positioning error loop is performed where each channel or speaker is checked to determine whether or not there is a positioning error and whether the error is greater than a determined threshold.

In some embodiments therefore the calibration processor 211 can determine for a first speaker an absolute positioning error value generated by the difference between the expected or reference speaker position and the audio signal estimated speaker position. In some embodiments the calibration processor 211 can then perform a speaker positioning error threshold check or test. The threshold test can determine when the absolute error value is greater than determined threshold value. For example a threshold value can be 5°, below which estimation error, reflections and other errors can cause calibration test problems.

The operation of performing the positioning error threshold test is shown in FIG. 6 by step 505.

In some embodiments the calibration processor 211, having determined that the positioning error is greater than a threshold for a first speaker, can generate a calibration parameter which would be applied in a playback operation as described herein. The calibration parameter can in some embodiments be the error value of the expected speaker position (or orientation) and the estimated speaker position (or orientation). In other words $C_N=\hat{\beta}_N-\beta_N$, where $\hat{\beta}_N$ is the expected speaker N position and $\beta_N$ is the estimated speaker N position. The 2π periodicity furthermore has to be again considered while defining the calibration parameter (if necessary).

The operation of generating a calibration parameter for a speaker is shown in FIG. 6 by step 507.

Where the error is lower than the threshold or after the generation of the calibration parameter then the calibration processor 211 can in some embodiments determine whether or not all of the speakers or channels have been tested.

The operation of testing or determining whether or not all of the speakers or channels have been tested is shown in FIG. 6 by step 509.

Where there are still speakers or channels to be tested then the calibration processor 211 can select the next speaker or channel to be tested for positioning errors and the loop passes back to the threshold test for the next speaker or channel.

The change to the next speaker or channel before performing the threshold test for the new speaker is shown in FIG. 6 by step 510.

Where all of the speakers or channels have been tested then the calibration processor 211 can be configured to output the calibration parameters or store the calibration parameters for later use.

The operation of outputting the calibration parameters is shown in FIG. 6 by step 511.

In some embodiments the calibration parameters can for example be passed to the home cinema system, all be stored in the apparatus memory for later use.

Figure 9:
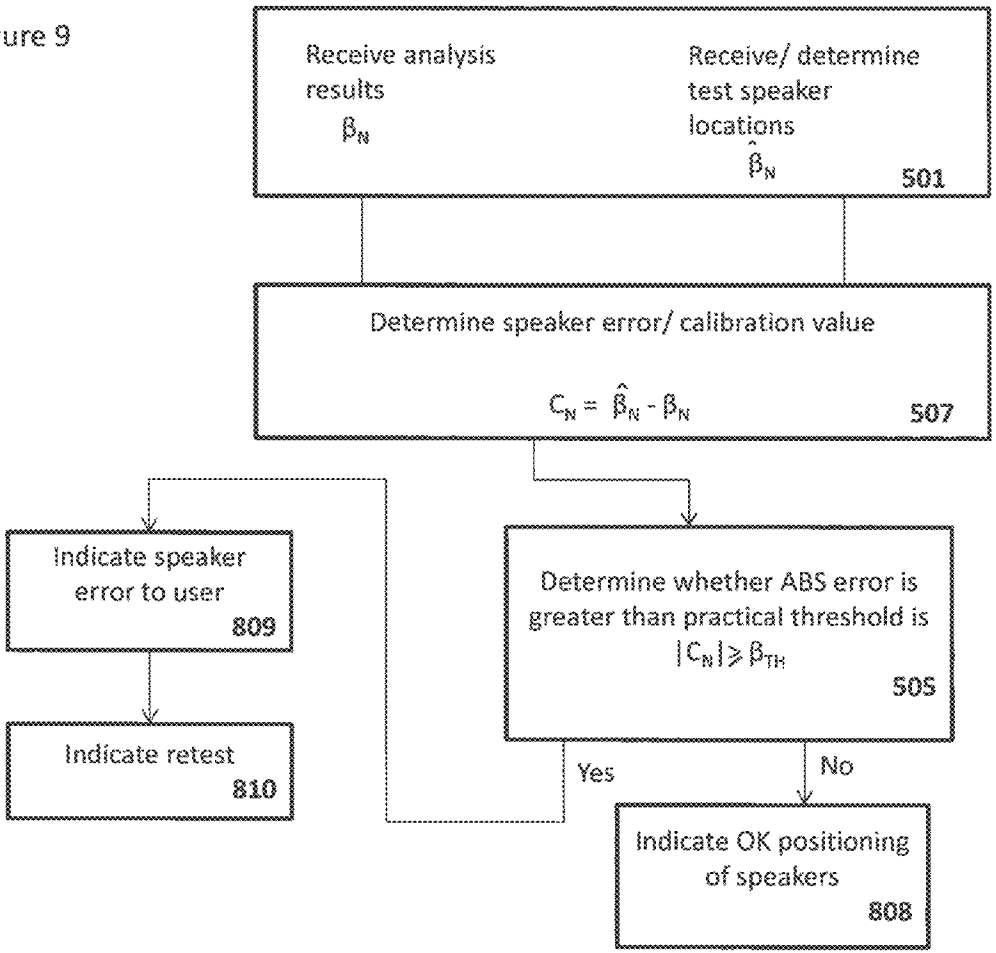
FIG. 9 shows a flow diagram of a further operation of the calibration apparatus in indicating incorrect speaker positioning error according to some embodiments.

With respect to FIG. 9 the operation of the calibration processor 211 according to some further embodiments is shown in further detail. The operation of the calibration processor 211 as documented by FIG. 9 differs from the operation of the calibration processor 211 as documented by FIG. 6 in that the calibration processor in FIG. 9 is configured to generate fault messages showing the speaker in error and in some embodiments corrective actions available rather than generating calibration parameters/error values to be used in playback. It would be understood that in some embodiments both the calibration parameters for playback (as shown in the embodiments in FIG. 6) and fault messages (as shown in the embodiments in FIG. 9) can be generated. Furthermore in the example shown in FIG. 9 no progression or order check is performed. It would be understood that in some embodiments a progression or order check is performed (with the possibility of generating missing speaker fault messages) as well as generating speaker positional fault messages.

In some embodiments the calibration processor 211 can be configured to retrieve or receive for each channel N the test signal direction analysis $_N$ (the estimated direction of speaker N according to the analysis).

The operation of retrieving the estimated direction for each channel in the test signal is shown in FIG. 9 step 501.

Furthermore in some embodiments the calibration processor 211 can, for each speaker, generate an error (or calibration parameter) value which is the expected speaker position (or orientation) and the estimated speaker position (or orientation). In other words $C_N=\hat{\beta}_N-\beta_N$, where $\hat{\beta}_N$ is the expected speaker N position and $\beta_N$ is the estimated speaker N position.

The operation of generating an error/calibration parameter for a speaker is shown in FIG. 9 by step 507.

In some embodiments a positioning error threshold check is performed. Thus in some embodiments therefore the calibration processor 211 can determine whether the absolute positioning error value generated by the difference between the expected or reference speaker position and the audio signal estimated speaker position is greater than a determined threshold value.

The operation of performing the positioning error threshold test is shown in FIG. 9 by step 505.

In the example shown in FIG. 9, the ordering of the calibration/error determination and the threshold check is reversed when compared to the example shown in FIG. 6 indicating that the ordering of these operations is variable.

Where the error is lower than the threshold then the calibration processor 211 can in some embodiments generate a 'speaker ok' indicator which in some embodiments can be passed and displayed on the apparatus display.

The operation of generating an ok indication is shown in FIG. 9 by step 505.

In some embodiments where the error is greater than (or equal to) the threshold then the calibration processor 211 can in some embodiments generate a 'speaker positioning error' indicator which in some embodiments can be passed and displayed on the apparatus display.

The operation of indicating a positioning error to the user is shown in FIG. 9 by step 809.

In some embodiments the indications of ok positioning and positioning errors can be shown on the display by the output of the error in a graphical form. For example the positions of the real speakers are shown as an overlay over an image of the reference positions.

Figure 10:
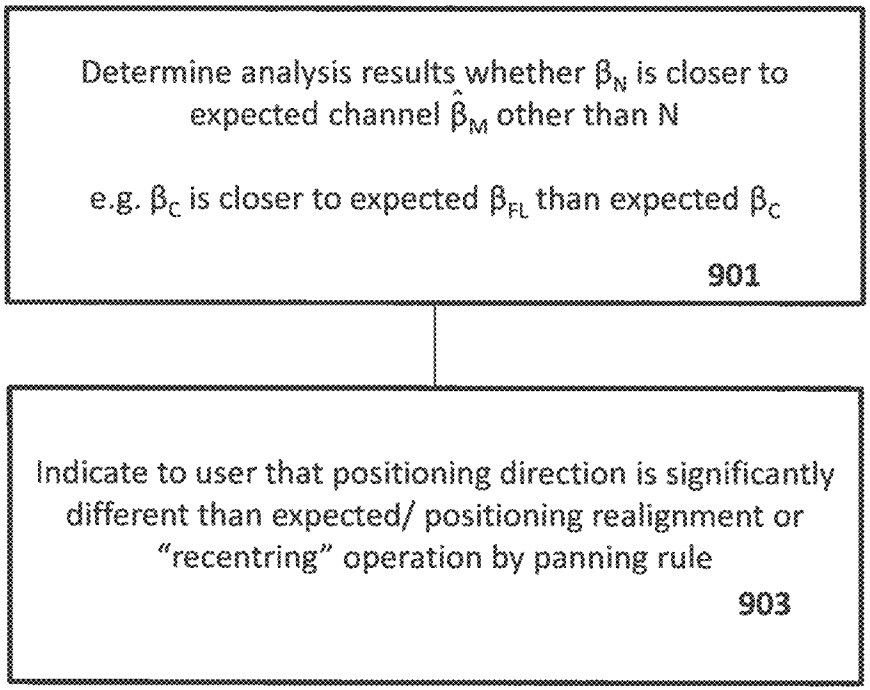
FIG. 10 shows a flow diagram of a further operation of the calibration apparatus in indicating and compensating for listening orientation error according to some embodiments.
Figure 11:
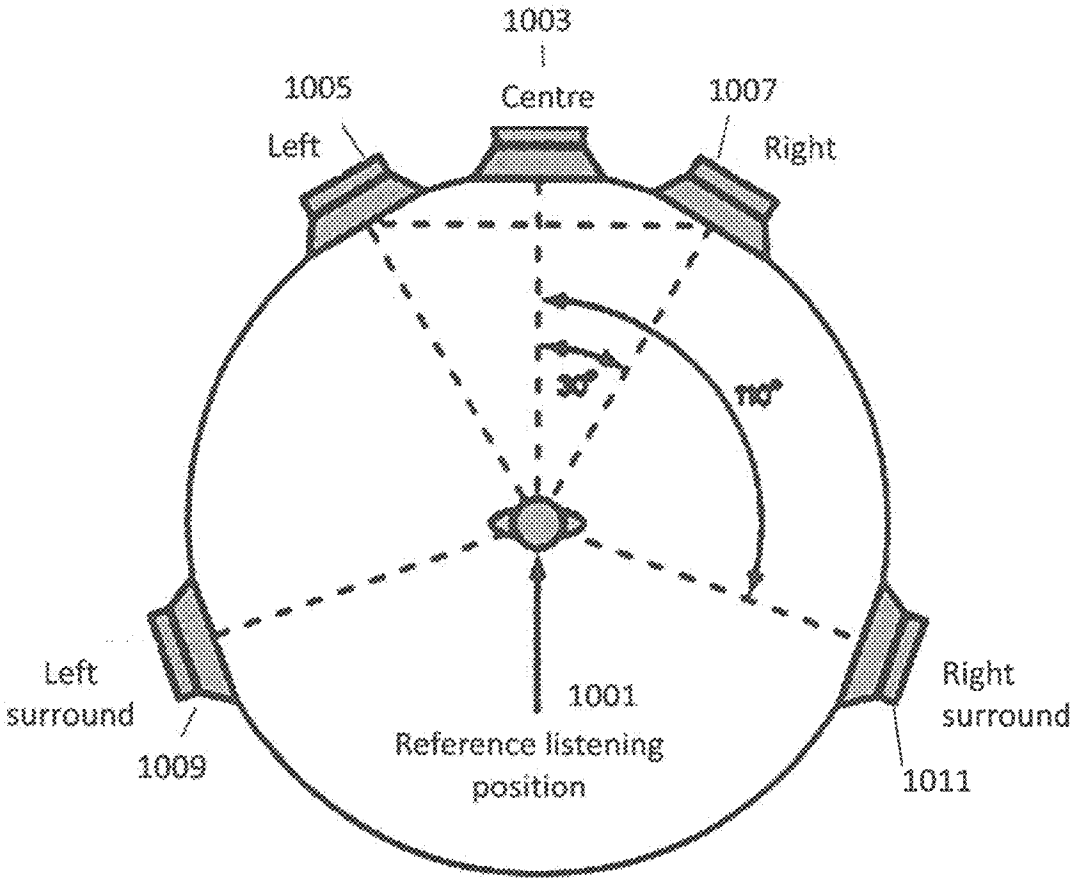
FIG. 11 shows schematically an 'ideal' 5.1 multichannel speaker location configuration.

With respect to FIG. 10 the operation of the calibration processor 211 according to some further embodiments is shown in further detail. The operation of the calibration processor 211 as documented by FIG. 10 differs from the operation of the calibration processor 211 as documented by FIGS. 6 and 10 in that the calibration processor as shown by the operations in FIG. 10 is configured to determine where the user is incorrectly positioned relative to the speaker system and generate calibration values which enable the compensation of the incorrect positioning or orientation of the user. It would be understood that in some embodiments both the calibration parameters for playback (as shown in the embodiments in FIG. 6), fault messages (as shown in the embodiments in FIG. 9) and user positioning error (such as shown in FIG. 10), or any combination of the three can be implemented.

As described herein in some embodiments the calibration processor 211 can be configured to retrieve or receive for each channel N the test signal direction analysis $_N$ (the estimated direction of speaker N according to the analysis).

Furthermore in some embodiments the calibration processor 211 can, for each speaker, generate an error (or calibration parameter) value which is the expected speaker position (or orientation) and the estimated speaker position (or orientation). In other words $C_N=\hat{\beta}_N-\beta_N$, where $\hat{\beta}_N$ is the expected speaker N position and $\beta_N$ is the estimated speaker N position. The calibration processor 211 can furthermore be configured to determine when the error values are such that for a majority of the speakers or channels the estimated speaker position is closer to a speaker position other than the expected speaker position. In some embodiments the calibration processor 211 can be configured to determine a user positioning error where the error values for the expected speaker positions are all of the same sign, in other words all positive or all negative and thus indicating that all of the speakers are positioned in error in the same direction or that the user is positioned incorrectly.

The operation of determining a user positioning error is shown in FIG. 10 by step 901.

In some embodiments the calibration processor 211 can be configured to generate a user positioning error message. The user positioning error message can for example be on the display. In some embodiments the user positioning error message can be displayed in a graphical form, such as a representation of the user overlaying a reference speaker system image to show the direction and approximate degree of the user positioning error.

In some embodiments calibration parameters are generated in a similar manner to speaker positioning errors which can be used in playback to compensate for the user positioning error. The calibration parameters can thus be used to 're-centre' the playback to the users position rather than the expected centre of the multichannel audio system.

The operation of generating a user positioning error message/calibration parameters for speakers is shown in FIG. 10 by step 903.

Figure 7:
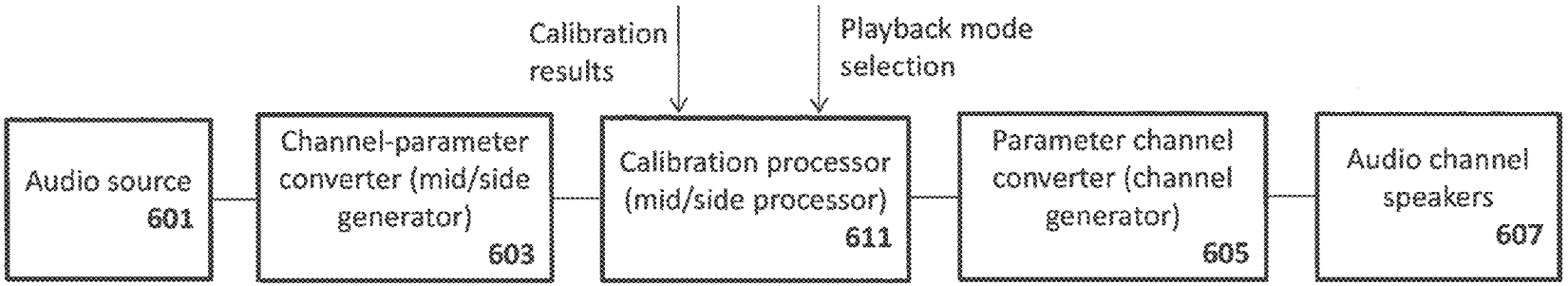
FIG. 7 shows schematically an example playback apparatus according to some embodiments.

With respect to FIG. 7 an example apparatus is shown in further detail from the perspective of the playback apparatus following the test or calibration.

Figure 8:
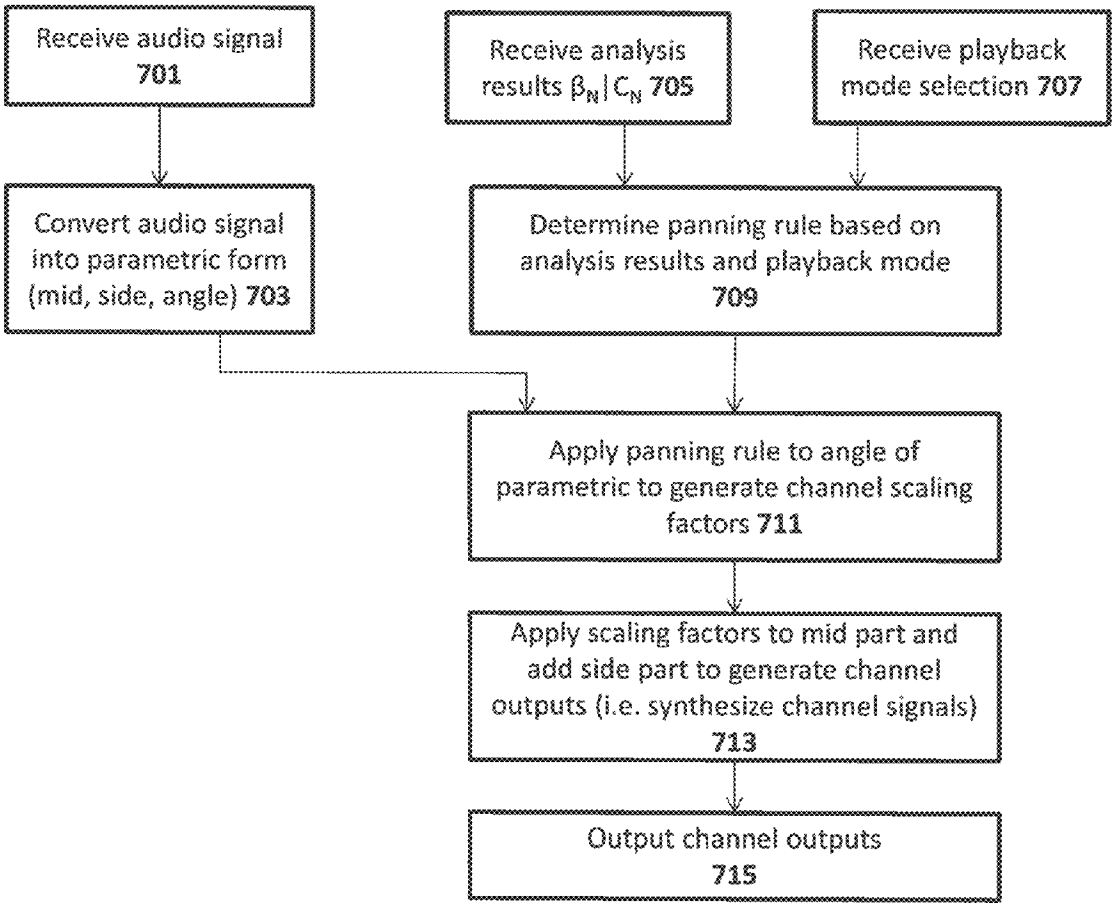
FIG. 8 shows a flow diagram of the operation of the example playback apparatus as shown in FIG. 7 according to some embodiments.

Furthermore with respect to FIG. 8 the method of performing the playback using calibration parameters as described in overview in FIG. 2*b* is described in further detail.

In some embodiments the example apparatus as shown in FIG. 7 is implemented within the same apparatus as shown in FIG. 3. However in some embodiments the example apparatus as shown in FIG. 7 is a separate apparatus configured to receive/store the calibration parameters and playback mode selections as described herein.

In some embodiments the apparatus comprises an audio source 601. The audio source 601 represents a receiver or memory from which the audio signal to be played is sourced with respect to the apparatus. The audio source 601 in some embodiments is configured to output the audio signal to a channel-parametric converter (a mid/side format generator) 603.

In the following example the audio signal to be played is any suitable format audio signal to be played on a multichannel audio system. It would be understood that in some embodiments where the audio source comprises an audio signal of suitable format (such as the mid/side audio signal format) then the audio source 601 is configured to output the audio signal to a playback processor 611.

The operation of receiving the audio signal is shown in FIG. 8 by step 701.

In some embodiments the apparatus comprises a channel parametric converter 603. The channel parametric converter 603 is in some embodiments configured to receive the audio signal from the audio source and convert it into a format suitable to be processed to compensate for errors in speaker positioning and/or user positioning.

The channel parametric converter 603 can for example in some embodiments convert the audio signal into a mid/side signal, where the mid signal for each signal has an associated angle.

The main content in the mid signal is the dominant sound source found from directional analysis. Thus in some embodiments the audio signal is directionally analysed in a manner similar to that of the received microphone audio signals as described herein. Similarly the side signal contains the other parts or ambient audio from the generated audio signals. In some embodiments the mid/side signal generator can determine the mid M and side S signals for a sub-band according to the following equations:

$$M^b = \begin{cases} \left(X^b_{2,\tau_b} + X^b_2\right)/2 & \tau_b \le 0 \\ \left(X^b_2 + X^b_{2,-\tau_b}\right)/2 & \tau_b > 0 \end{cases}$$

-continued $$S^b = \begin{cases} \left(X^b_{2,\tau_b} - X^b_2\right)/2 & \tau_b \le 0 \\ \left(X^b_2 - X^b_{2,-\tau_b}\right)/2 & \tau_b > 0 \end{cases}$$

The converted audio signal can then in some embodiments be passed to a playback processor 611.

The operation of converting the audio signal into a parametric form is shown in FIG. 8 by step 703.

In some embodiments the apparatus comprises a playback processor 611. The playback processor 611 in some embodiments is configured to receive from the channel parametric converter 603 or from the audio source 601 an audio signal. Furthermore in some embodiments the playback processor 611 is configured to receive from the calibration processor the analysis results, such as the calibration parameters.

The operation of receiving the analysis results are shown in FIG. 8 by step 705.

In some embodiments the playback processor 611 is configured to furthermore receive a playback mode selection. In some embodiments the apparatus can be configured to 'ask' the user to select one of the playback setups saved to the apparatus. The playback mode can in some embodiments represent possible listening positions or possible listening positions within various rooms or using various multichannel audio playback systems. In some embodiments the selection of the playback mode can include a test, calibration or analysis option which would enable the apparatus to perform a test or calibration operation such as described herein so that the apparatus can generate the calibration parameters. In some embodiments the playback setup selection can be used to perform a lookup from the analysis results and select an associated set of the analysis results based on the playback setup selection.

The operation of receiving the playback selection is shown in FIG. 8 by step 707.

It would be understood that the receiving of the analysis results and playback selection operation can be performed in either order.

The playback processor 611, in some embodiments, can be configured to determine a panning rule or rules based on the analysis results and playback mode selections.

In some embodiments the panning rule is an energy based panning. For example a sound source in subband b which is to be positioned in the direction $\phi$ and between two speakers 1 and 2 then the panning rule in general is:

$$g^b_1 = \sqrt{\frac{\beta_2 - \varphi}{\beta_2 - \beta_1}}$$

$$g^b_2 = \sqrt{\frac{\varphi - \beta_1}{\beta_2 - \beta_1}}$$

where and the scaling factor g for all other channels is 0.

For example for a 5.1 channel audio system where it is recognized that in the analyzed system $\beta_{RF}<\phi<\beta_{RR}$, i.e. $\phi$ is between right front and rear speakers then the panning rule used can be:

$$g^b_{FL} = 0$$

$$g^b_C = 0$$

-continued $$g^b_{FR} = \sqrt{\frac{\beta_{RR} - \varphi}{\beta_{RR} - \beta_{FR}}}$$

$$g^b_{RR} = \sqrt{\frac{\varphi - \beta_{FR}}{\beta_{RR} - \beta_{FR}}}$$

$$g^b_{RL} = 0.$$

where $g_x$ is the scaling factor for channel X. Notice that $(g_{RF}{}^b)^2+(g_{RR}{}^b)^2=1$, i.e. the total energy is always 1. Accordingly, it is possible to generate similar equations for all values in the range $[0, 2\pi]$, in other words considering the $2\pi$ periodicity, the nearest speakers on both sides are first searched and using similar panning logic.

It would be understood that other panning scaling factors can be generated including non-linear channel distribution.

The operation of determining or selecting a panning rule and applying the panning rule to generate scaling factors is shown in FIG. 8 by steps 709 and 711 respectively.

In some embodiments the playback processor 611 can be configured to output the panning rule to a parametric to channel converter 605.

The apparatus in some embodiments can comprise a parametric to channel converter 605. The parametric to channel converter 605 can be configured to receive the panning rules and the mid and side signals, apply the panning rules to the mid signals and further add the side signals to synthesise a multichannel audio signal to be output to an amplifier/speaker.

For example in some embodiments the parametric to channel converter 605 is configured to synthesise for each channel the mid component. This can for example be generated by applying for each speaker/channel the scaling factor to the mid component. Thus for example for a 5.1 channel system a synthesis for the directional signal can be as follows:

$$C_M{}^b = g_C{}^b M^b$$

$$F_L_M{}^b = g_{FL}{}^b M^b$$

$$F_R_M{}^b = g_{FR}{}^b M^b,$$

$$R_L_M{}^b = g_{RL}{}^b M^b$$

$$R_R_M{}^b = g_{RR}{}^b M^b$$

where $M^b$ is the mid-signal for sub-band b. In some embodiments a scaling factor smoothing is possible to be applied.

Furthermore in some embodiments the side components can be added to each channel/speaker to create a sub-band by sub-band synthesized audio signal.

The operation of synthesising the channel audio signals is shown in FIG. 8 by step 713.

In some embodiments the parameter-channel converter 605 can be configured to output to the audio channel speakers 607, or amplifier powering the audio channel speakers.

The operation of outputting the channels is shown in FIG. 8 by step 715.

FIGS. 12 to 15 show the example results of employing some embodiments.

Figure 12:
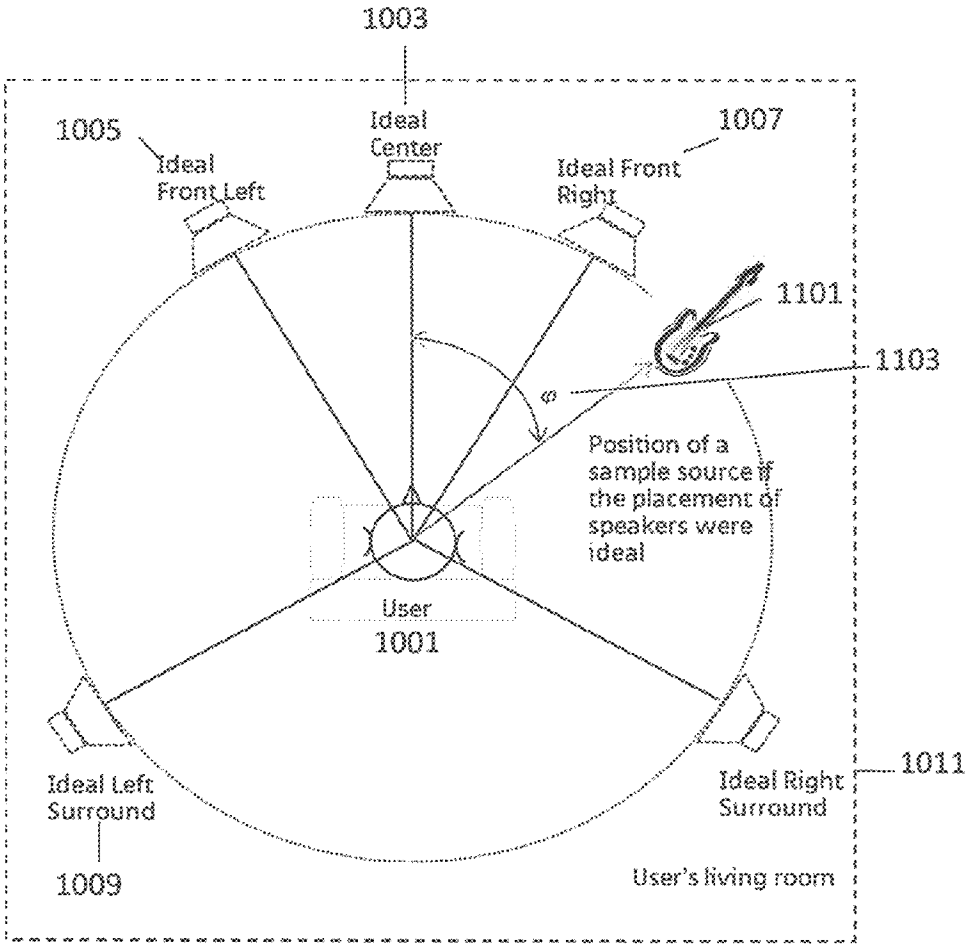
FIG. 12 shows schematically an audio object position for an example audio object reproduced within an 'ideal' 5.1 multichannel speaker location configuration.

FIG. 12 for example shows an example multichannel audio system with ideal positioning. Thus for example the user 1001 is located positioned towards the ideal centre 1003 speaker, with ideal positioned front left 1005, front right 1007, left surround 1009 and right surround 1011 speakers.

Furthermore FIG. 12 shows the position 1103 of an example audio source 1101 playback where the placement of the speakers are ideal.

Figure 13:
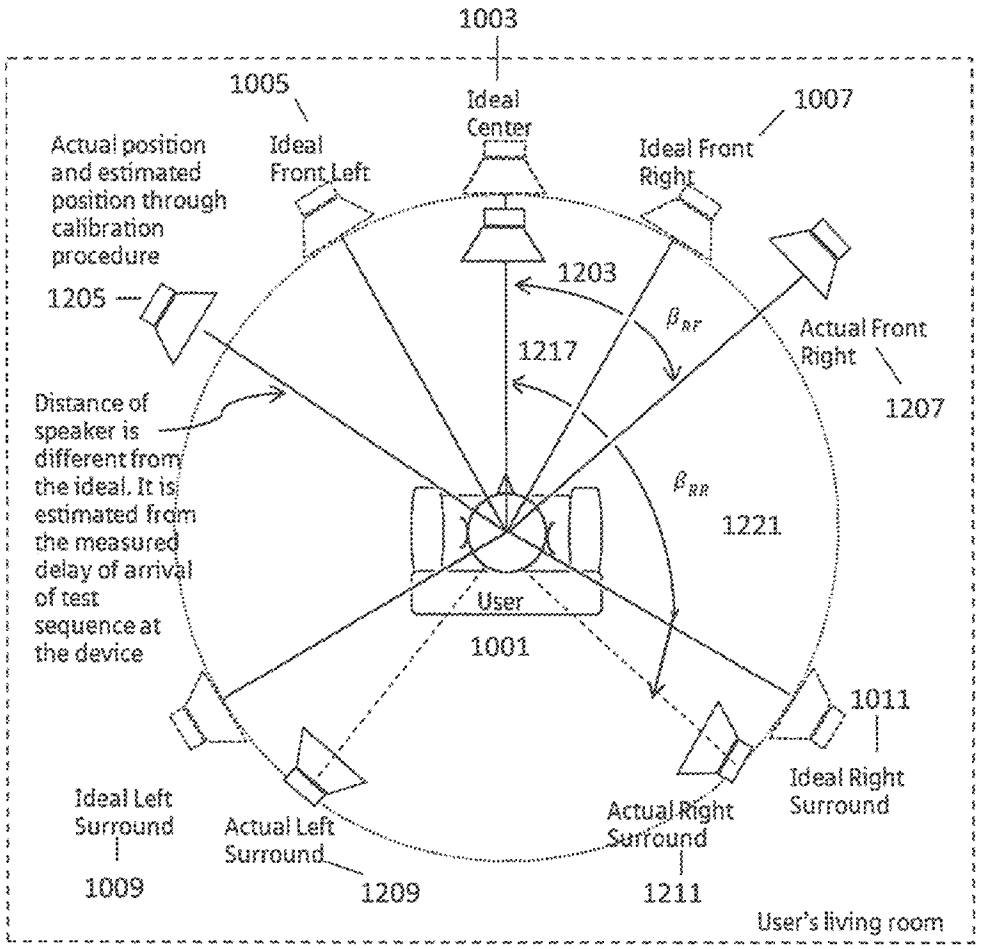
FIG. 13 shows schematically an example non-ideal 5.1 multichannel speaker location configuration with an 'ideal' 5.1 multichannel speaker location configuration overlay.

FIG. 13 furthermore shows an example non-ideal multi-channel audio system speaker positioning. Thus for example the user 1001 is located positioned towards the ideal centre 1003 speaker with the example centre 1203 speaker located position (orientation wise) correctly but closer to the user 1001. The ideal positioned front left speaker 1005, with an example front left speaker 1205 located to the left and further away than the ideal. The ideal positioned front right speaker 1007, with an example front right speaker 1207 located to the right (with an angle $_{RF}$ 1217) and further away than the ideal. The ideal positioned left surround speaker 1009, with an example left surround speaker 1209 located to the left and nearer than the ideal, and the ideal positioned right surround speaker 1011, with an example right surround speaker 1211 located to the right (with an angle $_{RR}$ 1221) and nearer than the ideal.

Figure 14:
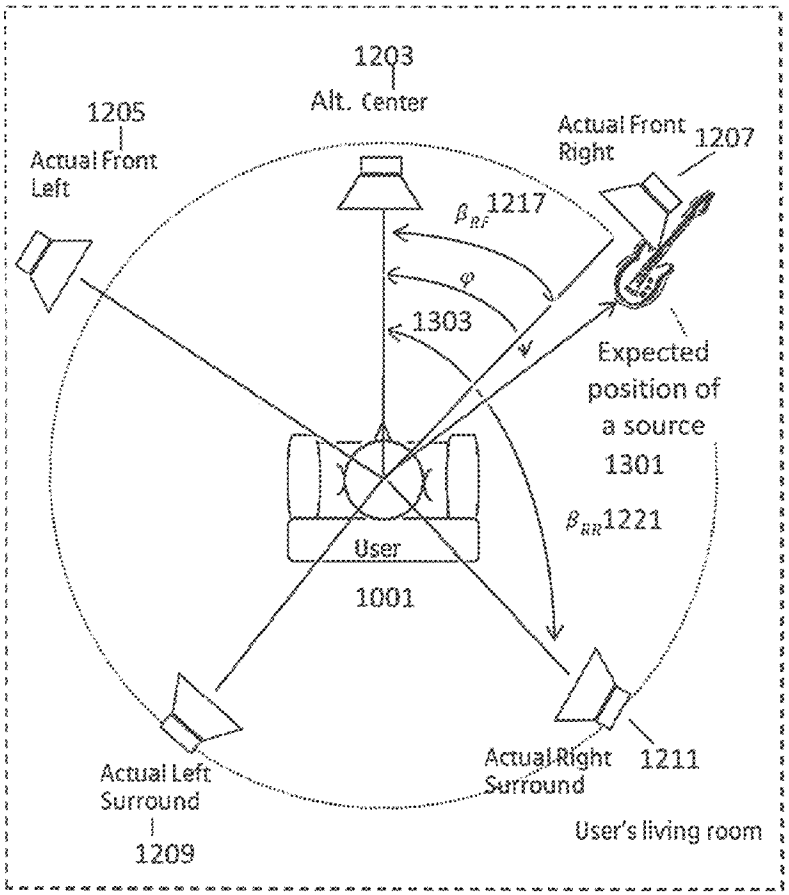
FIG. 14 shows schematically the desired audio object position for an example audio object as shown in FIG. 12 with reference to the example non-ideal 5.1 multichannel speaker location configuration as shown in FIG. 13.
Figure 15:
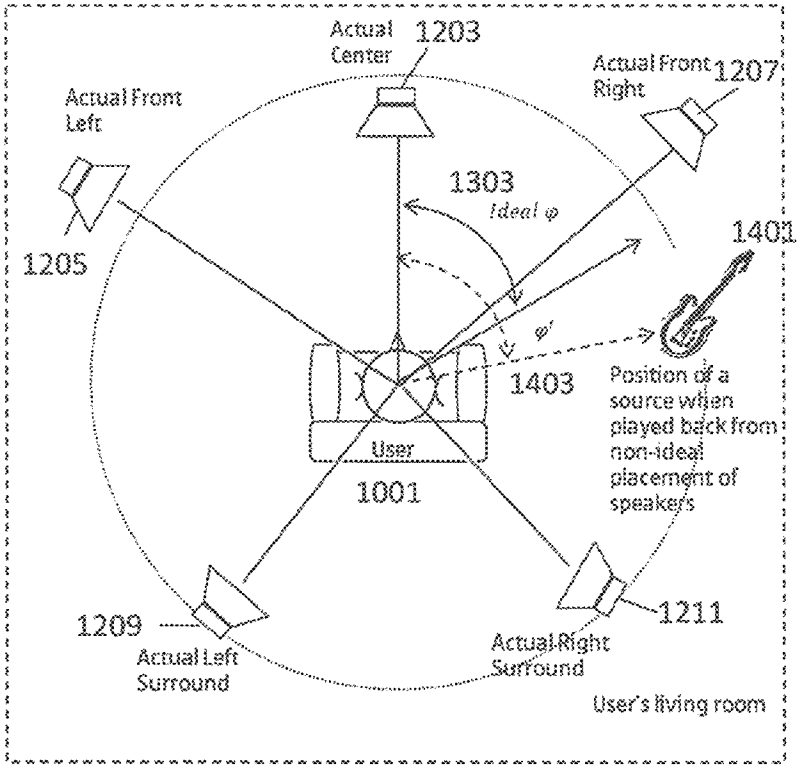
FIG. 15 shows schematically a resultant output audio object position for the example audio object as shown in FIGS. 12 and 14 with reference to the example non-ideal 5.1 multichannel speaker location configuration as shown in FIG. 13.

FIG. 15 shows the result of attempting to output the example audio source 1101 as shown in FIG. 13 where the placement of the speakers are non-ideal such as shown in FIG. 14 where the ideal angle 1303 is changed by the non-ideal speaker locations to a new position 1403 with a new angle ' 1403. FIG. 14 shows an example of the application of the embodiments described herein where the non-ideal speaker location/positions are compensated for and location of the expected position 1301 of the audio source is corrected to the 'ideal' or original angle 1303.

It shall be appreciated that the term user equipment is intended to cover any suitable type of wireless user equipment, such as mobile telephones, portable data processing devices or portable web browsers, as well as wearable devices.

Furthermore elements of a public land mobile network (PLMN) may also comprise apparatus as described above.

In general, the various embodiments of the invention may be implemented in hardware or special purpose circuits, software, logic or any combination thereof. For example, some aspects may be implemented in hardware, while other aspects may be implemented in firmware or software which may be executed by a controller, microprocessor or other computing device, although the invention is not limited thereto. While various aspects of the invention may be illustrated and described as block diagrams, flow charts, or using some other pictorial representation, it is well understood that these blocks, apparatus, systems, techniques or methods described herein may be implemented in, as non-limiting examples, hardware, software, firmware, special purpose circuits or logic, general purpose hardware or controller or other computing devices, or some combination thereof.

The embodiments of this invention may be implemented by computer software executable by a data processor of the mobile device, such as in the processor entity, or by hardware, or by a combination of software and hardware. Further in this regard it should be noted that any blocks of the logic flow as in the Figures may represent program steps, or interconnected logic circuits, blocks and functions, or a combination of program steps and logic circuits, blocks and functions. The software may be stored on such physical media as memory chips, or memory blocks implemented within the processor, magnetic media such as hard disk or floppy disks, and optical media such as for example DVD and the data variants thereof, CD.

The memory may be of any type suitable to the local technical environment and may be implemented using any suitable data storage technology, such as semiconductor-based memory devices, magnetic memory devices and systems, optical memory devices and systems, fixed memory and removable memory. The data processors may be of any type suitable to the local technical environment, and may include one or more of general purpose computers, special purpose computers, microprocessors, digital signal processors (DSPs), application specific integrated circuits (ASIC), gate level circuits and processors based on multi-core processor architecture, as non-limiting examples.

Embodiments of the inventions may be practiced in various components such as integrated circuit modules. The design of integrated circuits is by and large a highly automated process. Complex and powerful software tools are available for converting a logic level design into a semiconductor circuit design ready to be etched and formed on a semiconductor substrate.

Programs, such as those provided by Synopsys, Inc. of Mountain View, Calif. and Cadence Design, of San Jose, Calif. automatically route conductors and locate components on a semiconductor chip using well established rules of design as well as libraries of pre-stored design modules. Once the design for a semiconductor circuit has been completed, the resultant design, in a standardized electronic format (e.g., Opus, GDSII, or the like) may be transmitted to a semiconductor fabrication facility or "fab" for fabrication.

The foregoing description has provided by way of exemplary and non-limiting examples a full and informative description of the exemplary embodiment of this invention. However, various modifications and adaptations may become apparent to those skilled in the relevant arts in view of the foregoing description, when read in conjunction with the accompanying drawings and the appended claims. However, all such and similar modifications of the teachings of this invention will still fall within the scope of this invention as defined in the appended claims.

We claim:

1. An apparatus comprising:

a signal generator configured to generate at least one audio signal to be output by at least one speaker for a multi-speaker system comprising a plurality of speakers;

at least two microphones distinct from the at least one speaker of the multi-speaker system and disposed at a listening position that is spaced apart from the at least one speaker of the multi-speaker system, wherein the at least two microphones are configured to provide at least two output signals based on the acoustic output of the at least one speaker in response to the at least one audio signal;

an audio signal analyser configured to determine a directional component associated with the at least two output signals; and a calibration processor configured to compare the directional component with an expected location of the at least one speaker so as to adjust audio playback of the at least one speaker.

2. The apparatus as claimed in claim 1, wherein the calibration processor further configured to determine a speaker positioning difference when the determined directional component differs with the expected location; and generate a speaker positioning error message to be displayed.

3. The apparatus as claimed in claim 1, wherein the calibration processor further configured to generate a message comprising at least one of: a speaker identification associated with the at least one speaker; an error value associated with a speaker positioning error; and a correction information to correct the speaker positioning error.

4. The apparatus as claimed in claim 1, wherein the calibration processor further configured to generate a speaker correction factor based on the difference between the determined directional component and the expected location of the at least one speaker.

5. The apparatus as claimed in claim 4, further comprises an audio output processor configured to apply the speaker correction factor during operation of the multi-speaker system so as to correct audio positioning of the at least one speaker.

6. The apparatus as claimed in claim 5, wherein the audio output processor further configured to determine an audio signal to be output comprising one or more location component so as to synthesise the audio signal to be output by the at least one speaker in the multi-speaker system based on the one or more location component of the audio signal.

7. The apparatus as claimed in claim 4, further comprises a transmitter configured to transmit the speaker correction factor to the multi-speaker system for correcting a location of the at least one speaker.

8. An apparatus comprising:

a signal generator configured to generate at least one audio signal to be output by at least one speaker for a multi-speaker system;

at least two microphones configured to provide at least two output signals based on the acoustic output of the at least one speaker in response to the at least one audio signal;

an audio signal analyser configured to determine a directional component associated with the at least two output signals;

a calibration processor configured to compare the directional component with an expected location of the at least one speaker so as to adjust audio playback of the at least one speaker; and a level detector configured to determine a volume level associated with the at least two output signals and an expected volume level of the at least one audio signal so as to determine whether the at least one speaker is at least one of: missing; not connected; or incorrectly connected, based on the comparison.

9. The apparatus as claimed in claim 1, wherein the audio signal analyser further comprises a generator configured to generate more than one directional component; and the calibration processor configured to compare each directional component with expected locations of at least two speakers to determine whether the respective locations of the at least two speakers are correct.

10. The apparatus as claimed in claim 1, wherein the apparatus further configured to determine the expected location of the at least one speaker.

11. A method comprising:

generating at least one audio signal to be output by at least one speaker for a multi-speaker system comprising a plurality of speakers;

receiving at least two output signals, the at least two output signals provided by at least two microphones based on the at least one acoustic output by the at least one speaker in response to the at least one audio signal, wherein the at least two microphones are distinct from the at least one speaker of the multi-speaker system and disposed at a listening position that is spaced apart from the at least one speaker of the multi-speaker system;

determining a directional component associated with the at least two output signals; and comparing the directional component with an expected location of the at least one speaker;

adjusting audio playback of the at least one speaker based on the comparison of the directional component with the expected location.

12. The method as claimed in claim 11, further comprising:

determining a speaker positioning difference when the directional component differs with the expected location; and generating a speaker positioning error message to be displayed.

13. The method as claimed in claim 12, wherein generating a speaker positioning error to be displayed comprises generating a message comprising at least one of:

speaker identification associated with the at least one speaker;

an error value associated with the speaker positioning error; and correction information to correct the speaker positioning error.

14. The method as claimed in claim 11, further comprising:

generating a speaker correction factor based on the difference between the directional component and the expected location of the at least one speaker.

15. The method as claimed in claim 14, further comprising applying the speaker correction factor during operation of the multi-speaker system so as to correct audio positioning of the at least one speaker.

16. The method as claimed in claim 15, further comprising determining an audio signal comprising one or more location component; and synthesising the audio signal to be output by the at least one speaker based on the one or more location component of the audio signal.

17. The method as claimed in claim 11, further comprising transmitting the speaker correction factor to the multi-speaker system for correcting the location of the at least one speaker towards the expected location of the at least one speaker.

18. The method as claimed in claim 11, further comprising:

comparing a volume level associated with the at least two output signals and an expected volume level of the at least one audio signal to be output by the at least one speaker for the multi-speaker system;

determining whether the at least one speaker is at least one of: missing; not connected; incorrectly connected, based on the comparison.

19. The method as claimed in claim 11, wherein determining a directional component associated with the at least two output signals comprises generating more than one directional component; and comparing each directional component with expected locations of at least two speakers to determine whether the respective locations of the at least two speakers are correct.

20. The method as claimed in claim 11, wherein determining an expected location of the at least one speaker further comprises at least one of:

selecting the expected location of the at least one speaker from a speaker configuration of the multi-speaker system which has the smallest difference when comparing the directional component with the expected location of the speaker;

selecting the expected location from a speaker configuration of the multi-speaker system according to a defined order in the speaker configuration; and selecting the expected location based on a user interface input.

* * * * *